US005893669A

United States Patent [19]

Sugai et al.

[11] Patent Number: 5,893,669

[45] Date of Patent: Apr. 13, 1999

[54] RIBBON FEEDING DEVICE FOR PRINTER

[75] Inventors: Makoto Sugai, Iruma; Hiromi Hibino, Machida, both of Japan

[73] Assignee: Citizen Watch Co., Ltd., Tokyo, Japan

[21] Appl. No.: 08/843,533

[22] Filed: Apr. 16, 1997

[30] Foreign Application Priority Data

Apr. 17, 1996 [JP] Japan ..... 8-118186
Sep. 5, 1996 [JP] Japan ..... 8-253971

[51] Int. Cl.[6] ..... B41J 33/14

[52] U.S. Cl. ..... 400/223; 400/231; 400/233

[58] Field of Search ..... 400/223, 225, 400/231, 233

[56] References Cited

U.S. PATENT DOCUMENTS 4,468,139 8/1984 Hattori .
4,798,487 1/1989 Hattori et al. ..... 400/223

FOREIGN PATENT DOCUMENTS 5-562 1/1993 Japan .
6-340159 12/1994 Japan .

OTHER PUBLICATIONS

Search Report GB 9707785.3.

*Primary Examiner*—John Hilten
*Attorney, Agent, or Firm*—McDermott, Will & Emery

[57] ABSTRACT

A ribbon feeding device for a printer, which is simple in structure and easy to assemble and in which engagement between a pinion supported on a carriage and a rack is maintained when the carriage for carrying a printing head moves toward and away from the rack without providing the rack with any engaging member. An arm is swingably supported on the carriage at one end thereof, and the pinion engaged with the rack and operatively connected with a transmission mechanism is rotatably supported on the other end of the arm. One end of a torsion coil spring for urging the pinion towards the rack is engaged with the arm and at the other end thereof is engaged with the carriage. In accordance with the movement of the carriage toward and away from the rack, the arm swings to keep the engagement between the pinion and the rack appropriately.

9 Claims, 15 Drawing Sheets

RIBBON FEEDING DEVICE FOR PRINTER

BACKGROUND OF THE INVENTION

1. Field of the Invention:

The present invention relates to a ribbon feeding device for feeding a ribbon of an ink ribbon cassette, which is detachably mounted on at carriage, in one way.

2. Description of Related Art:

There is known a ribbon feeding device having a rack extending in the moving direction of a carriage, a V-shaped arm having a proximal end pivotally mounted on a pivot on the carriage, a pinion rotatably mounted on one distal end of the arm and meshing with the rack, and a ribbon winding mechanism operatively connected to the pinion, so as to rotate a winding shaft of the ribbon winding mechanism by the rotational force of the pinion in mesh with the rack by the movement of the carriage, from Japanese Patent Laid-Open Publication No. Hei 5-562.

In this ribbon feeding device, the other distal end of the arm is connected to a printing-head-mounting plate on which a printing head is mounted, and an approaching/retracting mechanism is provided for moving the printing-head-attaching plate toward and away from a platen with respect to the carriage. When the printing head is moved toward the platen by the approaching/retracting mechanism, the one distal end of the arm is moved toward the rack so that the pinion is brought into engagement with the rack, to operate the ribbon winding mechanism to wind the ribbon. When the printing head is retracted away from the platen by the approaching/retracting mechanism, the one distal end of the arm is moved away from the rack so that the pinion is brought out of engagement with the rack, so as to make the ribbon winding mechanism inoperative not to wind the ribbon.

A printer is known from Japanese Patent Laid-Open Publication No. Hei 6-340159, in which a carriage for carrying a printing head is slidably fitted on a guide shaft to be moved longitudinally of the platen and the carriage is also moved toward and away from the platen in accordance with the thickness of the individual paper sheet by an eccentric angular movement of the guide shaft so as to print on various kinds of paper sheets of differing thicknesses. A pinion is provided on the carriage to be engaged with a rack extending in the moving direction of the carriage in front of the guide shaft and is rotated by the longitudinal movement of the carriage, so that an ink ribbon of the ink ribbon cassette on the carriage is fed by the rotating force of the pinion. A cassette-attaching base mounted on the carriage is slidably engaged with the rack, and the rack is arranged slightly movable in the direction toward and away from the platen and is urged away from the carriage by a spring to keep the pinion in mesh with a rack while the carriage is moved toward and away from the platen.

The rack has first and second guide grooves along its length for engaging the rack with the carriage in this printer, and the cassette-attaching base mounted on the carriage has first and second rack-engaging ridges to be fitted in the first and second guide grooves, respectively, so that the front wall of the rack is sandwiched between the first and second rack-engaging ridges.

Further, a slider for rotatably supporting the pinion is slidably fitted to the first and second guide grooves, respectively, and the pinion has a large-diameter-gear section meshing with the rack and a small-diameter-gear section operatively connected to a ribbon feed mechanism.

According to the above arrangement, in order to prevent the pinion from coming out of engagement with the rack, it is necessary to provide the rack with the first and second guide grooves and to provide the cassette-attaching base with the first and second rack-engaging ridges as well as the sliders. Therefore, the apparatus is complex in structure and hence expensive to manufacture. Further, since the cassette-attaching base has to be engaged with the rack and the slider has to be slidably fitted to the first and second guide grooves, assembling of the device would be laborious and time-consuming.

SUMMARY OF THE INVENTION

An object of the present invention is to provide a ribbon feeding device for a printer, which is simple in structure and easy to assemble and in which engagement between a pinion movable with a carriage and a rack is maintained, without providing any direct engaging means on the rack, when the carriage is moved toward and away from the platen.

According to a first aspect of the invention, a ribbon feeding device for a printer comprises: a carriage, on which an ink ribbon cassette is detachably mounted, for moving the ink ribbon cassette together with a printing head in a direction traversing a paper feeding direction; a rack extending in the moving direction of the carriage; an arm swingably supported on a pivot shaft provided on the carriage; a pinion rotatably supported on the arm and engaged with the rack to be rotated by the rack when the carriage moves in the direction traversing the paper feeding direction; urging means for urging the arm to swing about the pivot shaft to thereby urge the pinion towards the rack; and a transmission mechanism for transmitting the rotation of the pinion to a rotation input member of the ink ribbon cassette.

The urging means may comprise a spring having one end engaged with the arm and the other end engaged with the carriage. The ribbon feeding device may further include restricting means for restricting a depth of engagement between the rack and the pinion urged by the urging means within a predetermined degree. The restricting means may include a follower roller rotatably supported on the arm to be rotated with the movement of the carriage, and a guide member extending parallel to the rack.

When the carriage is moved in the direction traversing the paper feeding direction, the pinion rotates in mesh with the rack and at the same time the rotation of the pinion is transmitted to the ribbon feed mechanism on the carriage to wind of the ribbon. When the carriage is moved toward and away from the rack, the engagement between the rack and the pinion rotatably supported on the arm is kept under the urging force of the urging means.

According to a second aspect of the invention, a ribbon feeding device for a printer comprises: a carriage, on which an ink ribbon cassette is detachably mounted, for moving the ink ribbon cassette with a printing head in a direction traversing a paper feeding direction; a rack extending in the moving direction of the carriage; a ribbon feed gear having a coaxially and integrally formed ribbon feed shaft, and rotatably supported on a first pivot shaft provided on the carriage; a first holder provided swingable about the first pivot shaft; a pinion rotatably supported on the first holder and engaged with the rack; a second holder rotatably supported on a second pivot provided on the first holder; a first transmission gear rotatably mounted on one end of the second holder, for receiving the rotation of the pinion to rotate the second holder to come into and out of engagement with the ribbon feed gear; a second transmission gear rotatably supported on the other end of the second holder and always engaged with the first transmission gear, said second transmission gear being brought into engagement with the ribbon feed gear when the first transmission gear is out of engagement with the ribbon feed gear and brought out of engagement with the ribbon feed gear when the first transmission gear is in engagement with the ribbon feed gear; and urging means for urging the first holder to swing about the first pivot shaft to thereby urge the pinion towards the rack.

The ribbon feeding device may comprise braking force generating means provided on at least one of a gear shaft of said first transmission gear and a gear shaft of the second transmission gear, for generating a braking force against the rotation of the first transmission gear and the second transmission gear.

The urging means may comprise a spring having one end engaged with the first holder and the other end engaged with the carriage. Further, a restricting member may be provided on the first holder for restricting a range of rotation of the second holder to optimize a depth of engagement between the first transmission gear and the ribbon feed gear and a depth of engagement between the second transmission gear and the ribbon feed gear.

DETAILED DESCRIPTION OF THE PREFERRED EMBODIMENTS

Figure 1:
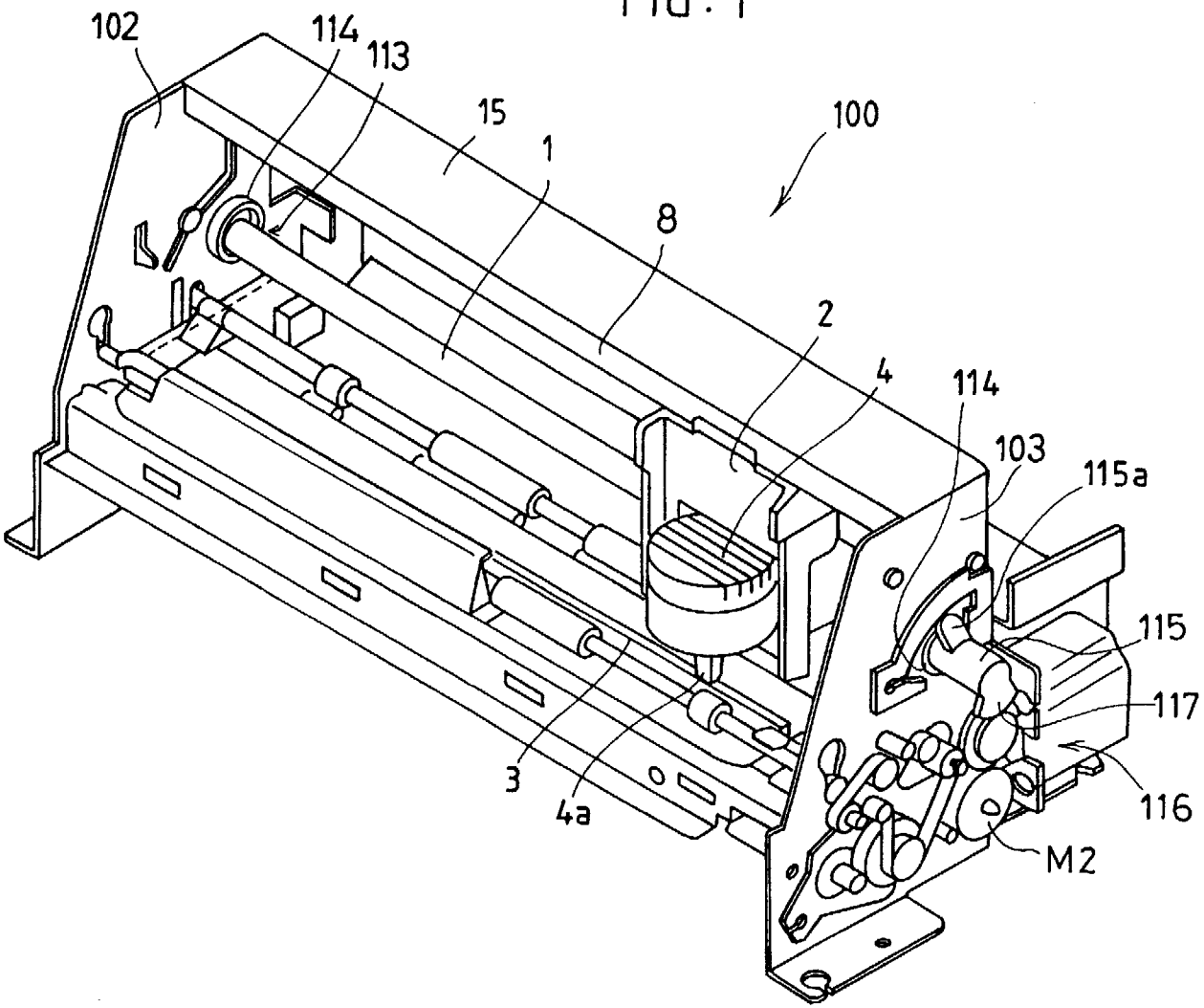
FIG. 1 is a perspective view showing a principal part of an impact-dot printer equipped with a ribbon feeding device of the present invention.

FIG. 1 shows a principal part of an impact-dot printer equipped with a ribbon feeding device of the present invention.

As shown in FIG. 1, a printer housing 100 has left and right side frames 102 and 103 parallel to each other. Between the left and right side frames 102 and 103, there extends a horizontal carriage shaft 1, on which a carriage 2 is slidably mounted for reciprocal movement in a horizontal direction traversing a paper feeding direction in the printer housing 100. As is described later, the carriage 2 is vertically movable together with the carriage shaft 1. A printing head 4 is removably attached to the carriage 2, with its dot-pin side 4*a* directed vertically downwardly. Right under a traveling path of the printing head 4, a platen 3 is disposed for receiving impact of dot pins of the printing head 4.

Figure 3:
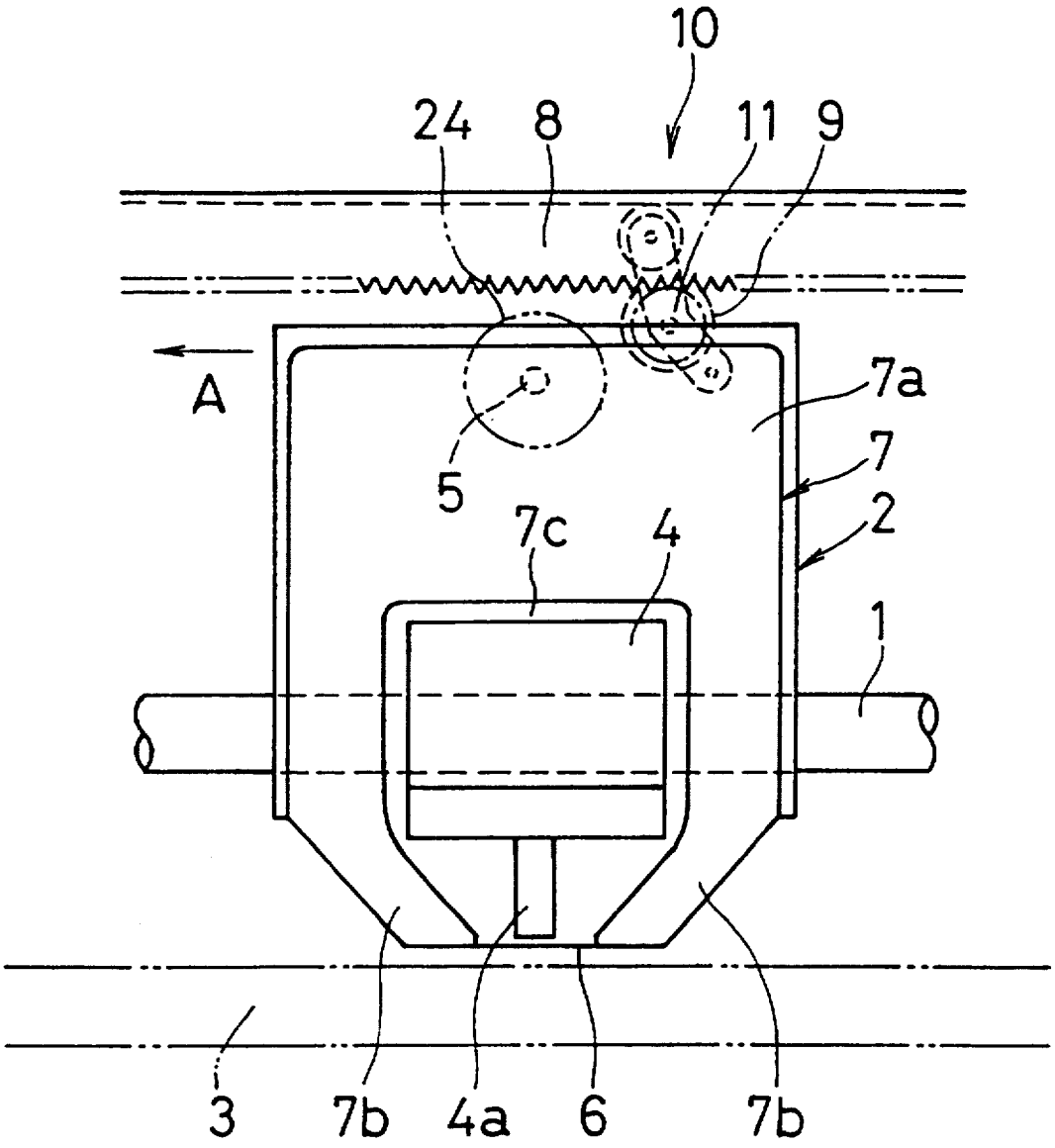
FIG. 3 is a front view generally showing a ribbon feeding device according to a first embodiment of the present invention.

Between an upper end of the left side frame 102 and an upper end of the right side frame 103, an upper frame 15 having a rack 8 extends horizontally. The rack 8 is formed vertically downwardly on the front side of the upper frame 15 in the moving direction of the carriage 2. A pinion 9 (FIG. 3) is provided on the top of the carriage 2 and engaged with the rack 8. On the back side of the carriage 2, a transmission mechanism is provided for transmitting the rotation of the pinion 9, which rotates with the movement of the carriage 2 along the rack 8, to a ribbon feed shaft 5 (FIG. 3).

Left and right eccentric shaft 113 are mounted at opposite ends of the carriage shaft 1 and are rotatably supported by a pair of bearings 114 secured on the left and right side frames 102, 103, respectively. The eccentric shaft 113 on the right side frame 103 has a protrusion 115, on the circumference thereof and on which an output gear 117 of a power transmission mechanism 116 is formed. The rotation of a reversible drive motor M2 is transmitted to the eccentric shaft 113 via the power transmission mechanism 116 so that the carriage 2 is moved vertically toward and away from the platen 3 within a range corresponding to double the distance between the central axis of each eccentric shaft 113 and the central axis of the carriage shaft 1. The distance between the platen 3 and the printing head 4 is thereby adjusted in accordance with the thickness of a paper sheet to be supplied to the space between the carriage 2 and an ink ribbon 6 arranged in front of the printing head 4. The eccentric shaft 113 has a lever 115*a* for restricting the angle of rotation of the eccentric pivot 113.

A carriage-moving mechanism 118, for moving the carriage 2 horizontally along the carriage shaft 1 in the printer housing 100, will be described referring to FIG. 2.

A carriage-moving motor M1 is disposed on the lower back side of the right side frame 103 and has a motor shaft (not shown) to which a drive gear 119 is fixed. Above the motor shaft, a pivot shaft 120 is provided parallel to the motor shaft between an auxiliary plate 131 and a back wall 103*a* of the right side frame 103. On the pivot shaft 120, a transmission gear 121 engaged with the drive gear 119 and a transmission pulley 122 coaxial and integral with the transmission gear 121 are rotatably supported.

A support member 123 is attached to the inner side of the of the left side frame 102, and a follower pulley 124 cooperating with the transmission pulley 122 is rotatably supported on the support member 123. A timing belt 125 is wound on the transmission pulley 122 and the follower pulley 124 to extend horizontally in the printer body 100, and the back side of the carriage 2 is fixedly connected to the upper side of the timing belt 125.

In the carriage-moving mechanism 118, the forward and reverse rotations of the motor shaft of the carriage moving motor M1 is transmitted to the transmission pulley 122 via the drive gear 119 and the transmission gear 121 so that the timing belt 125 is horizontally moved back and forth between the transmission pulley 122 and the follower pulley 124 to move the carriage 2 back and forth along its horizontal moving path in the printer housing 100.

FIGS. 3 through 7 show a ribbon feed apparatus according to a first embodiment of the invention.

Figure 4:
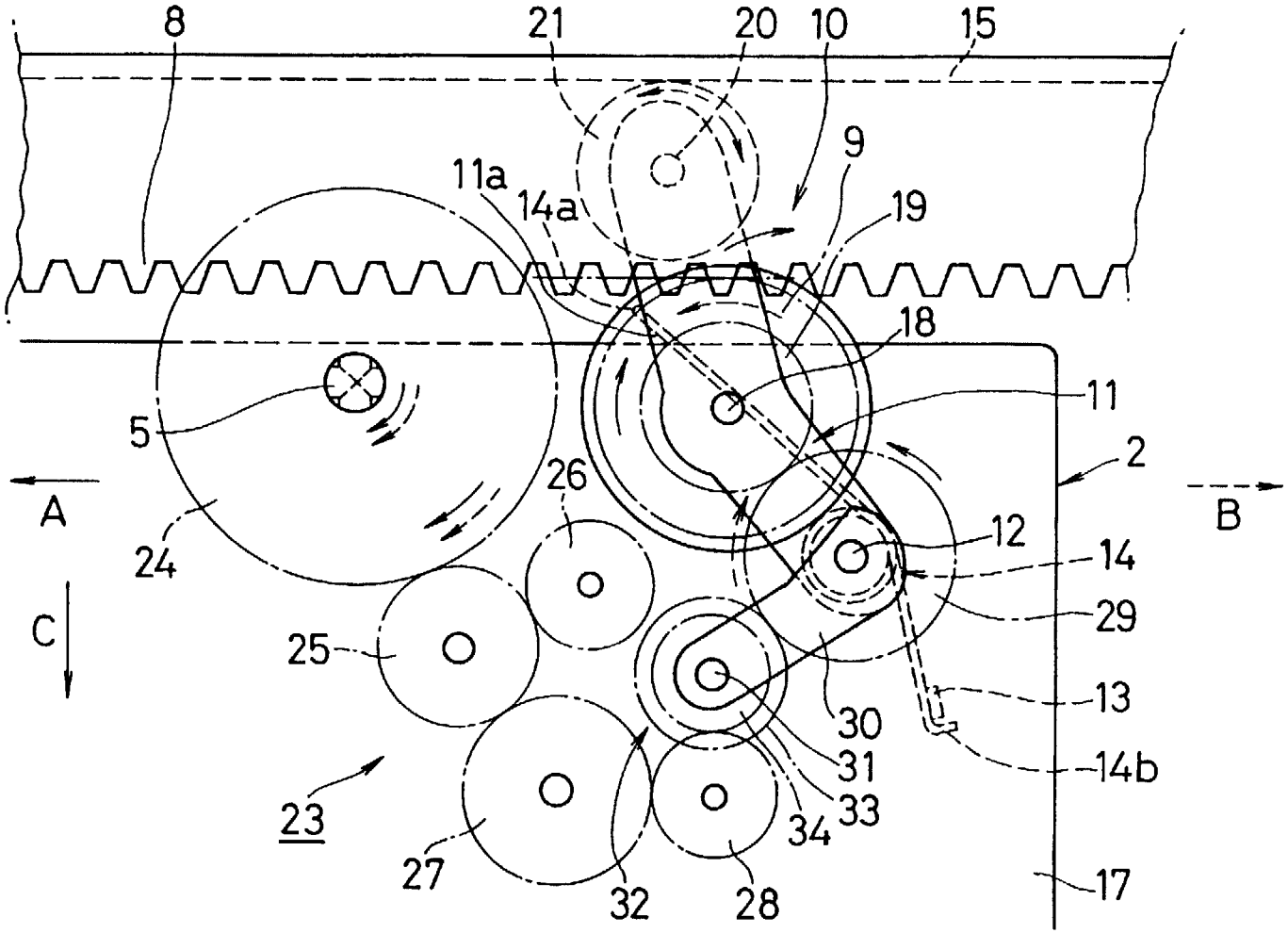
FIG. 4 is an enlarged front view of the ribbon feeding device shown in FIG. 3, in a state where a printing head is placed farthest from a platen.

Inside the carriage 2 of FIG. 3, a transmission mechanism 23 as shown in FIG. 4 is disposed and a ribbon feed shaft 5, as an output shaft of the transmission mechanism 23, is projected on the upper surface of the carriage 2 near the back end thereof. On the front surface of the carriage 2, an ink ribbon cassette 7 for supplying an ink ribbon 6 to the space between a head portion 4*a* of a printing head 4 and a platen 3 is removable attached.

The ink ribbon 6 is accommodated in a body 7*a* of the ink ribbon cassette 7, and a pair of guide arms 7*b*, through which the ink ribbon 6 passes, projects from the cassette body 7*a*. Between the two guide arms 7*b*, a space 7*c* is formed for disposing the printing head 4, and the ink ribbon 6 runs between distal ends of the guide arms 7*b* in one way as exposed to the space therebetween. On the back side of the cassette body 7*a*, a rotation input portion is provided to which the ribbon feed shaft 5 is fitted, when the cassette body 7*a* is attached to the carriage 2, so that a rotating force of the ribbon feed shaft 5 is inputted to the rotation input portion.

An arm 11 is provided swingably on the top of the carriage 2, and a pinion 9 engaged with a rack 8 is rotatably supported on the arm 11 so that the rotation of the pinion 9, which moves along the rack 8 and rotates with the horizontal movement of the carriage 2, is transmitted to the transmission mechanism 23.

As shown in FIG. 4, the ribbon feeding device 10 comprises: the rack 8 extending in the moving direction of the carriage 2; the arm 11 having one end pivotally supported by the pivot shaft 12 on the carriage 2; the pinion 9 rotatably supported at an intermediate position of the arm 11 and engaged with the rack 8; a torsion coil spring 14 having one end 14*a* engaged with a portion 11*a* of the arm 11 and the other end 14*b* engaged with a portion of the carriage 2, for urging the pinion 9 towards the rack 8; and the transmission mechanism 23 to transmit the rotation of the pinion 9 to the ribbon feed shaft 5.

Figure 5:
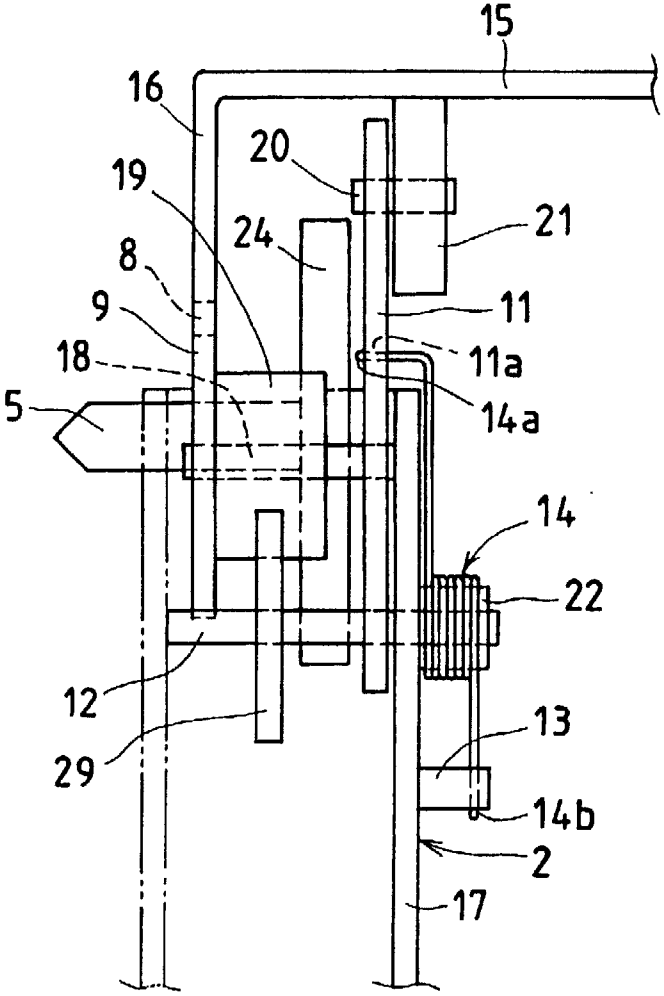
FIG. 5 is a side view of the ribbon feeding device shown in FIG. 4.

As shown in FIG. 5, the upper frame 15 of the printer housing 100 of FIG. 1 has a projection 16 extending toward the carriage 2 and the rack 8 is provided on a distal end of the projection 16. The rack 8 extends in the moving direction of the carriage 2 in parallel to the upper frame 15.

As shown in FIG. 5, near the back end of the right-hand side of the carriage 2, the pivot shaft 12 extends toward the back side through a bottom plate 17, and a proximal end of the arm 11 is pivotally supported by the pivot shaft 12 on the inner side of the bottom plate 17. A gear shaft 18 has one end fixedly attached to an intermediate position of the arm 11, and the pinion 9 and a transmission gear 19 coaxially and integrally formed with the pinion 9 are rotatably supported on the gear shaft 18. A roller shaft 20 is provided to project downwardly near the distal end of the arm 11 and a follower roller 21 is rotatably supported on the roller shaft 20.

A cylindrical boss 22 is formed integrally with the bottom plate 17 around a portion of the pivot shaft 12 projecting from the back surface of the bottom plate 17 of the carriage 2, and an engaging portion 13 stands at a position spaced from the boss 22 on the back surface of the bottom plate 17. Around the boss 22, the torsion coil spring 14 is wound. The coil spring 14 has one end 14*a* engaged with the engaging portion 11*a* at the left side edge between the distal end and the intermediate position of the arm 11, and the other end 14*b* engaged with the engaging portion 13 on the back surface of the bottom plate 17 of the carriage 2.

Accordingly, the arm 11 is always urged clockwise about the pivot shaft 12 in FIG. 4 by the torsion coil spring 14 so that the pinion 9 provided at the intermediate position of the arm 11 is urged towards the rack 8 to keep engagement with the rack 8.

Further, the follower roller 21 rotatably supported on the arm 11 and the upper frame 15 parallel to the rack 8 cooperate to restrict the depth of engagement between the rack 8 and the pinion 9 under the elastic force of the torsion coil spring 14 within a predetermined degree. The follower roller 21 near the distal end of the arm 11 is in contact with the upper frame 15 to restrict the posture of the arm 11, and the engagement between the rack 8 and pinion 9 is adjusted to an appropriate degree of friction so that the pinion 9 is prevented from engaging the rack 8 too deeply.

The transmission mechanism disposed inside the carriage 2 will be described below.

As shown in FIG. 4, a ribbon feed gear 24 is rotatably supported on the bottom plate 17 of the carriage 2 at an intermediate position near the back end thereof, and also first, second, third and fourth transmission gears 25, 26, 27, 28 are rotatably supported on the bottom plate 17 on the front-right side of the ribbon feed gear 24. Also a fifth transmission gear 29 is rotatably supported on the pivot shaft 12 at an intermediate position thereof In addition, a pair of confronting gear support plates 30 is rotatably supported at one end thereof on the pivot shaft 12, and a gear shaft 31 extends between the other ends of the two gear support plates 30. On the gear shaft 31, a sixth transmission gear 32 having a large-diameter gear 33 and a small-diameter gear 34 coaxially and integrally formed with each other is rotatably supported. The ribbon feed gear 24 has the ribbon feed shaft 5 projecting from the carriage 2.

The ribbon feed gear 24 is engaged with the first transmission gear 25 and the first transmission gear 25 is engaged with the second transmission gear 26 spaced from the ribbon feed gear 24 and the third transmission gear 27, which in return meshes with the fourth transmission gear 27 for the purpose of reversing the rotation.

The large-diameter gear 33 of the sixth transmission gear is engaged with the fifth transmission gear 29 rotatably supported on the pivot shaft 12, and the small-diameter gear 34 of the sixth transmission gear 32 is engaged selectively with one of the second and fourth transmission gears 26 and 28 in accordance with the swinging movement of the gear support plate 30 about the pivot shaft 12.

Further, the fifth transmission gear 29 of the transmission mechanism 23 is engaged with the transmission gear 19 rotatably supported on the gear shaft 18 of the arm 11 in the ribbon feeding device 10.

The operation of the ribbon feeding device 10 will be described below.

When the carriage 2 is moved to the left in the direction of a solid-line arrow A along the carriage shaft 1 in FIG. 3, the arm 11 swingably supported on the pivot shaft 12 of the carriage 2 is moved together with the carriage 2 to the left in the direction of the arrow A in FIG. 4 so that the pinion 9 rotatably supported on the arm 11 moves to the left in the direction of the arrow A in engagement with the rack 8. The pinion 9 and the transmission gear 19 integrally formed with the pinion 9 rotate clockwise in the direction of a solid-line arrow. Simultaneously, the follower roller 21 supported near the distal end of the arm 11 rotates clockwise in contact with the upper frame 15 so that the arm 11 is moved in the direction of the arrow A, keeping its posture with an appropriate degree of friction in engagement between the pinion 9 and rack 8.

This clockwise rotation of the pinion 9 is transmitted to the fifth transmission gear 29 through the transmission gear 19 integrally formed with the pinion 9, so that the fifth transmission gear 29 is rotated counterclockwise in the direction of a solid-line arrow to rotate the ribbon feed gear 24 and the ribbon feed shaft 5 clockwise, thus feeding the ink ribbon 6 of the ink ribbon cassette 7 of FIG. 3 in the winding direction.

When the carriage 2 is moved to the right in the direction of a broken-line arrow B along the carriage shaft 1 in FIG. 4, the arm 11 swingably supported on the pivot shaft 12 is moved to the right in the direction of the arrow B with the carriage 2 so that the pinion 9 rotatably supported on the arm 11 moves to the right in the direction of the arrow B with the arm 11 in engagement with the rack 8. The pinion 9 and the transmission gear 19 rotate counterclockwise in the direction of a dotted-line arrow. Simultaneously, the follower roller 21 supported on the arm 11 is rotated counterclockwise in contact with the upper frame 15 so that the arm 11 is moved in the direction of the arrow B, keeping its posture with an appropriate degree of friction in engagement between the pinion 9 and rack 8.

This counterclockwise rotation of the pinion 9 is transmitted to the fifth transmission gear 29 through the transmission gear 19, so that the fifth transmission gear 29 is rotated clockwise in the direction of a dotted-line arrow to rotate the ribbon feed gear 24 and the ribbon feed shaft 5 clockwise, thus feeding the ink ribbon 6 of the ink ribbon cassette 7 of FIG. 3 in the winding direction.

The carriage 2 is moved downwardly and upwardly toward and away from the platen 3 to adjust the distance between the platen 3 and the printing head 4 carried by the carriage 2 in accordance with the thickness of a paper sheet to be supplied to the space between the platen 3 and the ink ribbon 6 running in front of the printing head 4. The range of movement of the carriage 2 is 0.3–2.0 mm. In FIG. 4, the carriage 2, on which the printing head 4 of FIG. 3 is mounted, is depicted as placed farthest from the platen 3.

In the case where the carriage 2 is moved closer to the platen 3, the carriage 2 is moved downwardly in the direction of a solid-line arrow C in FIG. 4 with the pivot shaft 12 so that the proximal end of the arm 11 is moved downwardly. Thus, in accordance with the downward movement of the carriage 2, the proximal end of the arm 11 is moved to place the pinion 9 away from the rack 8. Simultaneously, however, the arm 11 swings clockwise towards the rack 8 by the elastic force of the torsion coil spring 14 so that the follower roller 21 supported on the arm 11 near the distal end is rotated counterclockwise in contact with the upper frame 15 and at the same time the pinion 9 rotates counterclockwise in engagement with the rack 8.

Figure 6:
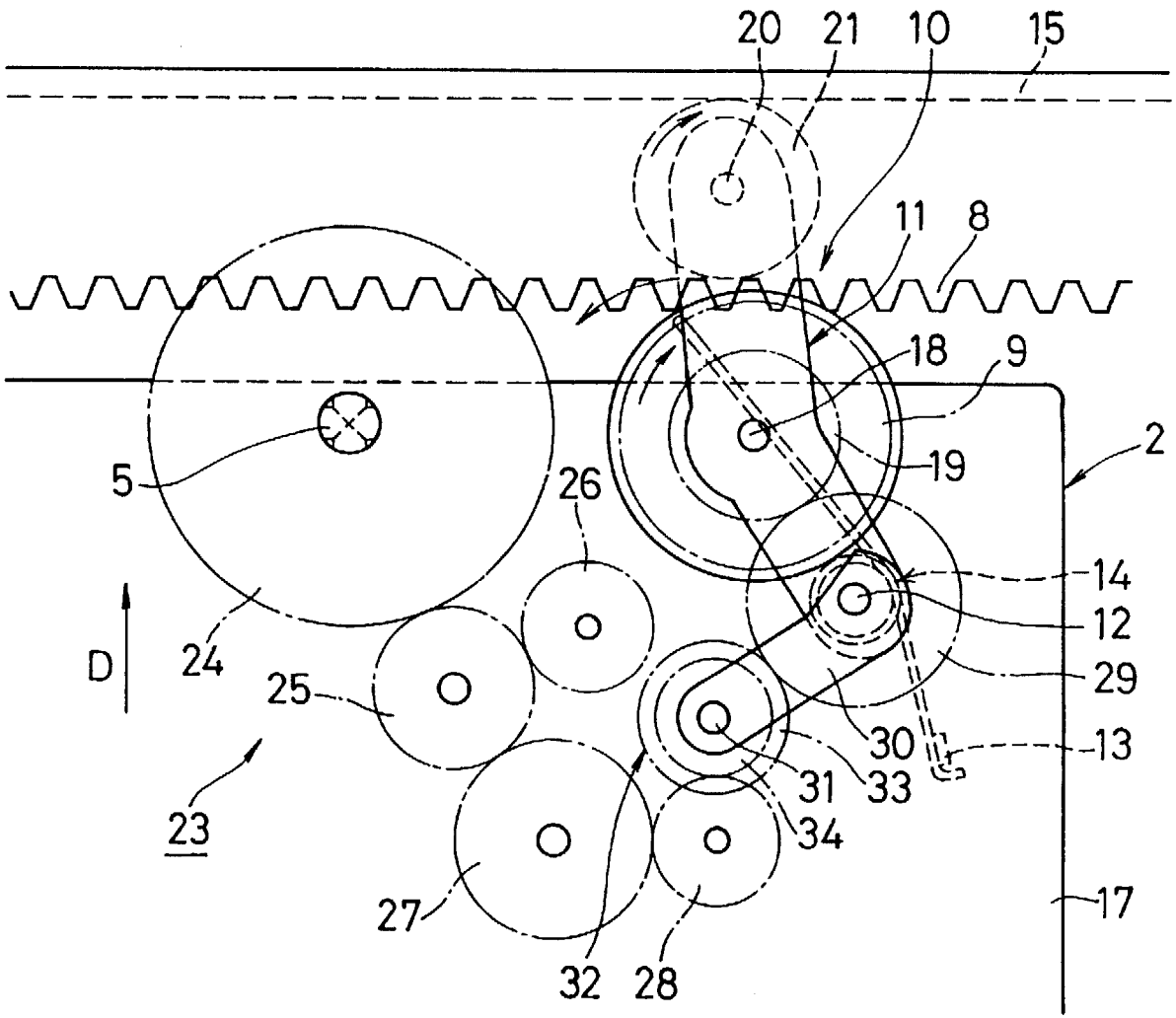
FIG. 6 is an enlarged front view of the ribbon feeding device shown in FIG. 3, in a state where the printing head is placed closest to the platen.

Upon termination of downward movement of the carriage 2 in the direction of the arrow C, the arm 11, the pinion 9 and the follower roller 21 are simultaneously stopped rotating. When the carriage 2 is moved to the down side, the arm 11 assumes the posture of FIG. 6 while the engagement between the pinion 9 and the rack 8 is maintained under the urging force of the coil spring 14. In FIG. 6, the carriage 2 carrying the printing head 4 of FIG. 3 is depicted as placed closest to the platen 3.

In the case where the carriage 2 in position of FIG. 6 is moved away from the platen 3, the carriage 2 is moved upwardly in the direction of a solid-line arrow D with the pivot shaft 12 so that the proximal end of the arm 11 is moved to upwardly in FIG. 6. In accordance with the upward movement of the carriage 2, the follower roller 21 supported near the distal end of the arm 11 receives a pressure from the upper frame 15. This pressure acts in such a direction as to swing the arm 11 counterclockwise about the pivot shaft 12 against the elastic force of the torsion coil spring 14. As a result, the follower roller 21 is rotated clockwise in contact with the upper frame 15 and at the same time the pinion 9 rotates clockwise in mesh with the rack 8, thus swinging the arm 11 counterclockwise about the pivot shaft 12.

Upon termination of upward movement of the carriage 2 in the direction of the arrow D, the arm 11, the pinion 9 and the follower roller 21 are simultaneously stopped rotating. When the carriage 2 is moved to the downward side, the arm 11 assumes the posture of FIG. 4 maintaining the engagement of the pinion 9 and the rack 8 under the urging force of the torsion coil spring 14.

According to the ribbon feeding device 10 of this embodiment, when the carriage 2 is moved downwardly and upwardly the arm 11 swings to maintain the engagement between the pinion 9 and the rack 8 under the elastic force of the torsion coil spring 26. It is therefore unnecessary to provide the rack 8 with an engaging portion for direct engagement with the carriage 2, thus making the device simple in structure and easy to assemble.

Figure 7:
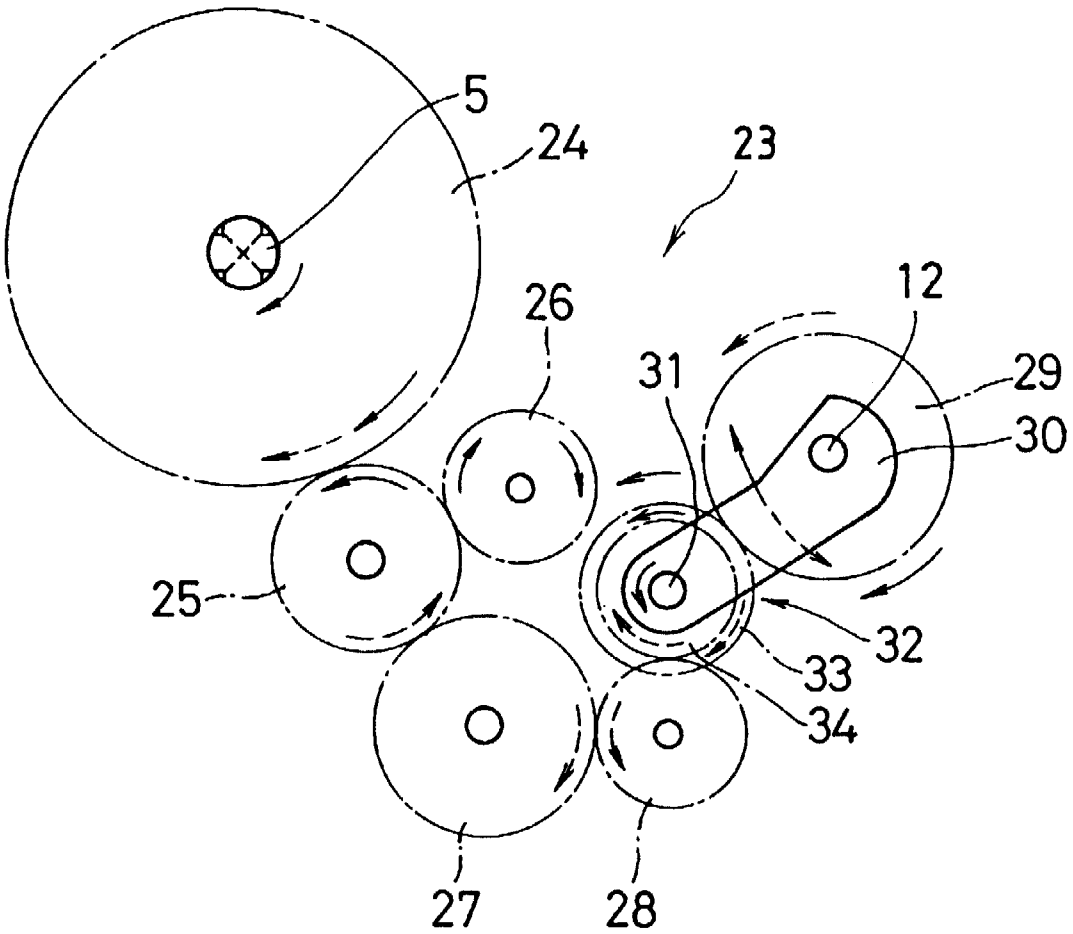
FIG. 7 is a front view of a transmission mechanism of the ribbon feeding device shown in FIG. 4.

The operation of the transmission mechanism 23 will be described referring to FIG. 7. When the fifth transmission gear 29 is rotated clockwise in the direction of a solid-line arrow in a state as shown in FIG. 7, the rotation of the fifth transmission gear 29 is transmitted to the large-diameter gear 33 of the sixth transmission gear 32 so that the sixth transmission gear 32 is rotated counterclockwise about the gear shaft 31. Simultaneously, this clockwise rotation of the fifth transmission gear 29 is transmitted to the gear support plates 30 via the large-diameter gear 33 and the gear shaft 31 to swing the gear support plates 30 clockwise about the pivot shaft 12 in the direction of a solid-line arrow in FIG. 15, thus bringing the small-diameter gear 34 of the sixth transmission gear 32 into engagement with the second transmission gear 26.

Upon engaging the small-diameter gear 34 of the sixth transmission gear 32 with the second transmission gear 26, the counterclockwise rotation of the small-diameter gear 34 is transmitted to the ribbon feed gear 24 via the second transmission gear 26 and the first transmission gear 25, so that the ribbon feed gear 24 and hence the ribbon feed shaft 5 are rotated clockwise, thus winding the ink ribbon 6 of the ink ribbon cassette 7 of FIG. 3.

When the fifth gear 29 is rotated counterclockwise in the direction of a broken-line arrow in a state where the sixth transmission gear 32 is engaged with the second transmission gear 26, the rotation of the fifth gear 29 is transmitted to the large-diameter gear 33 of the sixth transmission gear 32, so that the sixth transmission gear 32 is rotated clockwise about the gear shaft 31. Simultaneously, this counterclockwise rotation of the fifth transmission gear 29 is transmitted to the gear support plates 30 via the large-diameter gear 33 and the gear shaft 31 to swing the gear support plates 30 counterclockwise about the pivot shaft 12 in the direction of a dotted-line arrow in FIG. 7, thus bringing the small-diameter gear 34 of the sixth transmission gear 32 into engagement with the fourth transmission gear 28.

This clockwise rotation of the small-diameter gear 34 of the sixth transmission gear 32 is transmitted to the ribbon feed gear 24 via the fourth transmission gear 28, the third transmission gear 27 and the first transmission gear 25, so that the ribbon feed gear 24 and the ribbon feed shaft 5 are rotated clockwise, thus winding the ink ribbon 6 of the ink ribbon cassette 7 of FIG. 3.

FIGS. 8 through 17 show a ribbon feeding device according to a second embodiment of the present invention.

In this embodiment, a carriage 105 is slidably mounted on a carriage shaft 1 likewise in the first embodiment. A platen 3 extends parallel to the carriage shaft 1 under the carriage 105, and a printing head 4 is mounted on the lower front side of the carriage 105.

Figure 8:
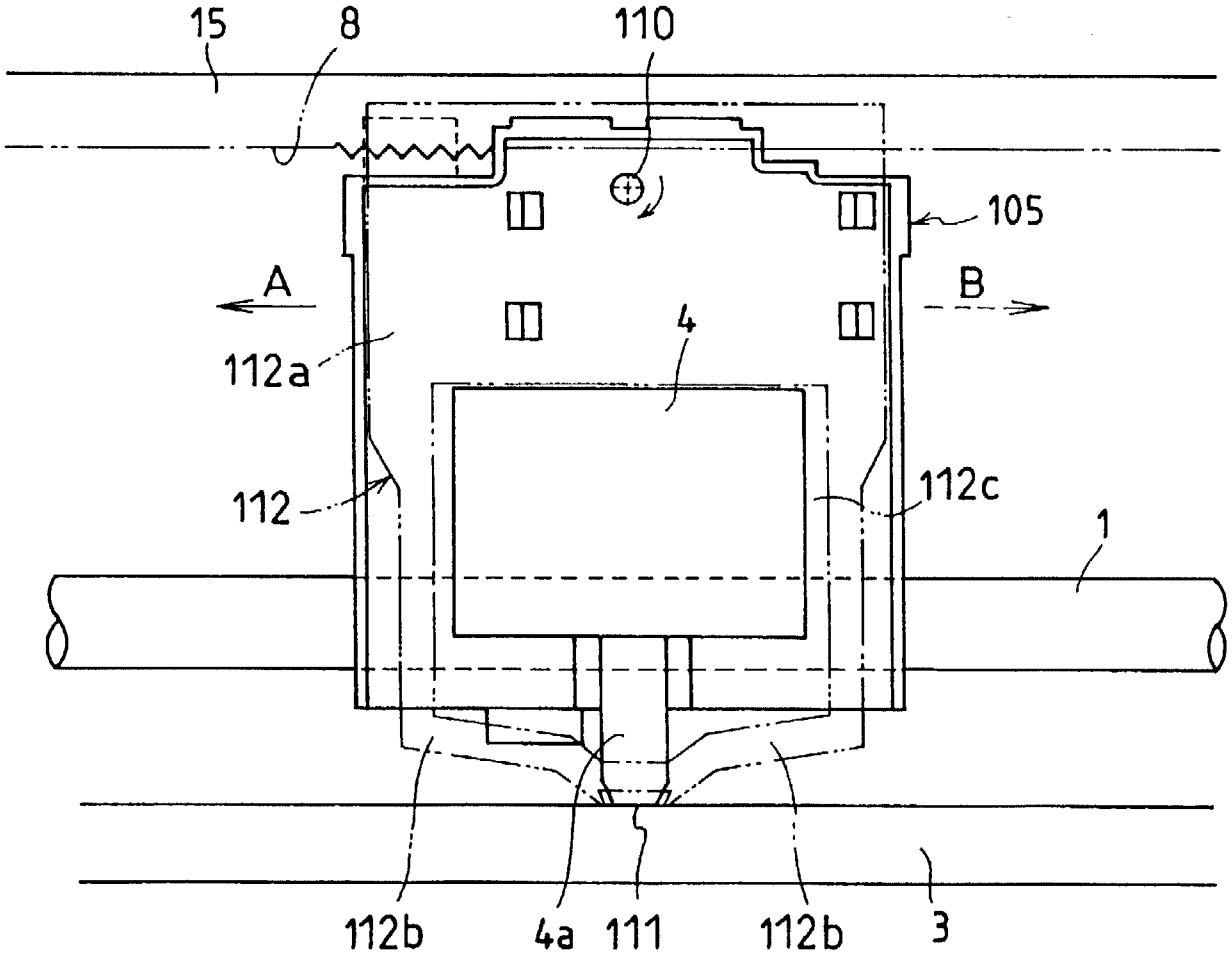
FIG. 8 is a front view generally showing a ribbon feeding device according to a second embodiment of the invention.

As shown in FIG. 8, a ribbon feed shaft 110 is rotatably mounted on the front surface of the carriage 105 at a central upper portion, and an ink ribbon cassette 112 for supplying an ink ribbon 111 to the space between the front surface of a dot-pin face 4*a* of the printing head 4 and the platen 3 is removably attached to the front surface of the carriage 105.

The ink ribbon 111 is accommodated in a body 112*a* of the ink ribbon cassette 112, and a pair of guide arms 112*b* through which the ink ribbon 111 passed projects from the cassette body 112*a*. The two guide arms 112*b* cooperate to define a space 112*c* in which the printing head 4 is disposed, and the ink ribbon 111 runs between distal ends of the guide arms 112*b* as exposed to the space therebetween. On the back side of the cassette body 112*a*, a rotation input member is provided to which the ribbon feed shaft 110 is fitted, when the cassette body 112*a* is attached to the carriage 105, so that a rotating force of the ribbon feed shaft 110 is inputted. Thus, the rotation input member is rotated with the ribbon feed shaft 110.

Figure 9:
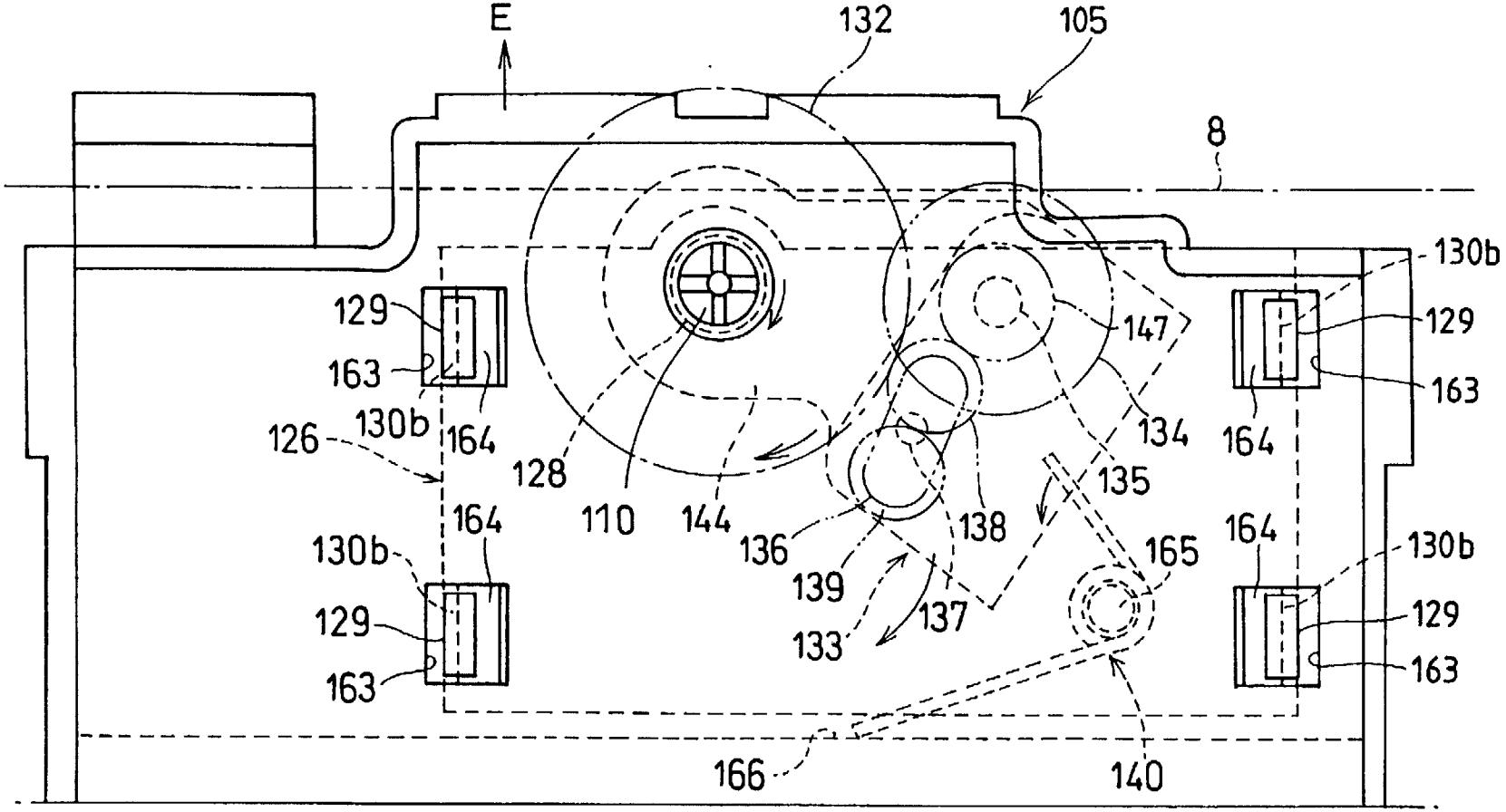
FIG. 9 is an enlarged front view of the ribbon feeding device shown in FIG. 8, in a state where the carriage is placed closest to the platen.
Figure 11:
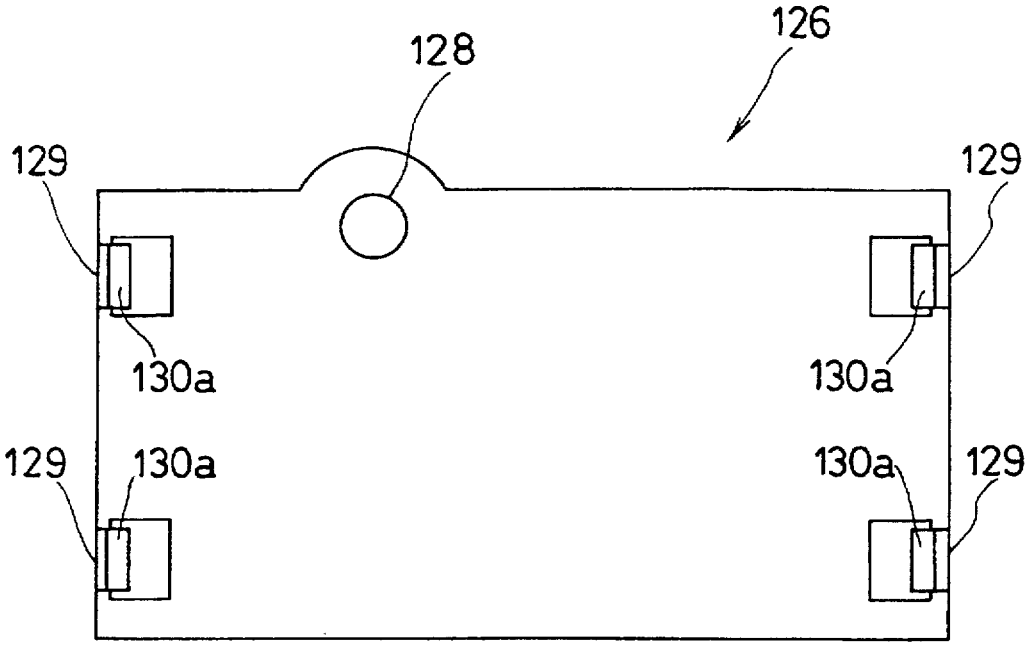
FIG. 11 is a front view of a support member.
Figure 12:
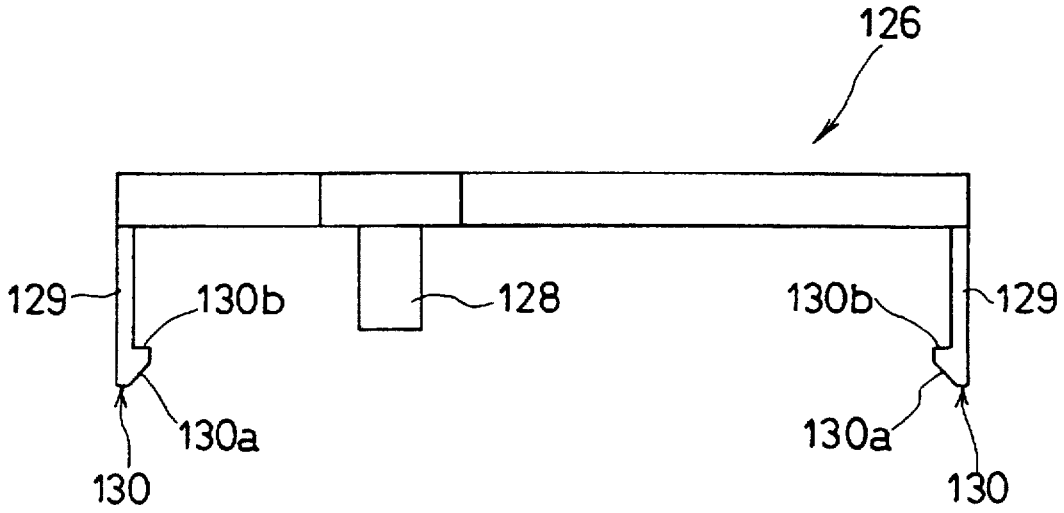
FIG. 12 is a plan view of the support member.

As shown in FIG. 9, on the back side of the carriage 105, a support member 126 as shown in FIGS. 11 and 12 is attached and a ribbon feed mechanism 127 is supported on the support member 126.

As shown in FIGS. 11 and 12, the support member 126 is a horizontally elongated rectangular plate having a forwardly projecting pivot shaft 128 near a central upper edge thereof and four forwardly extending supporting legs 129 at left and right edges near the upper and lower ends. Each supporting leg 129 projects forwardly and having a locking portion 130 with a tapered head 130*a* sloping inwardly from its distal end and a flat jaw 130*b* extending perpendicular to the supporting leg 129.

As shown in FIG. 9, a ribbon feed gear 132 having the ribbon feed shaft 110, which projects from the front surface of the carriage 105 and is formed coaxially and integrally with the ribbon feed gear 132, is rotatably supported on the pivot shaft 128. A first holder 133 is swingably supported also on the pivot shaft 128. On the first holder 133, a pinion 134 is rotatably supported by a shaft 135 integrally formed with the pinion 34 and a second holder 136 is pivotally supported by its pivotal shaft 137.

Figure 10:
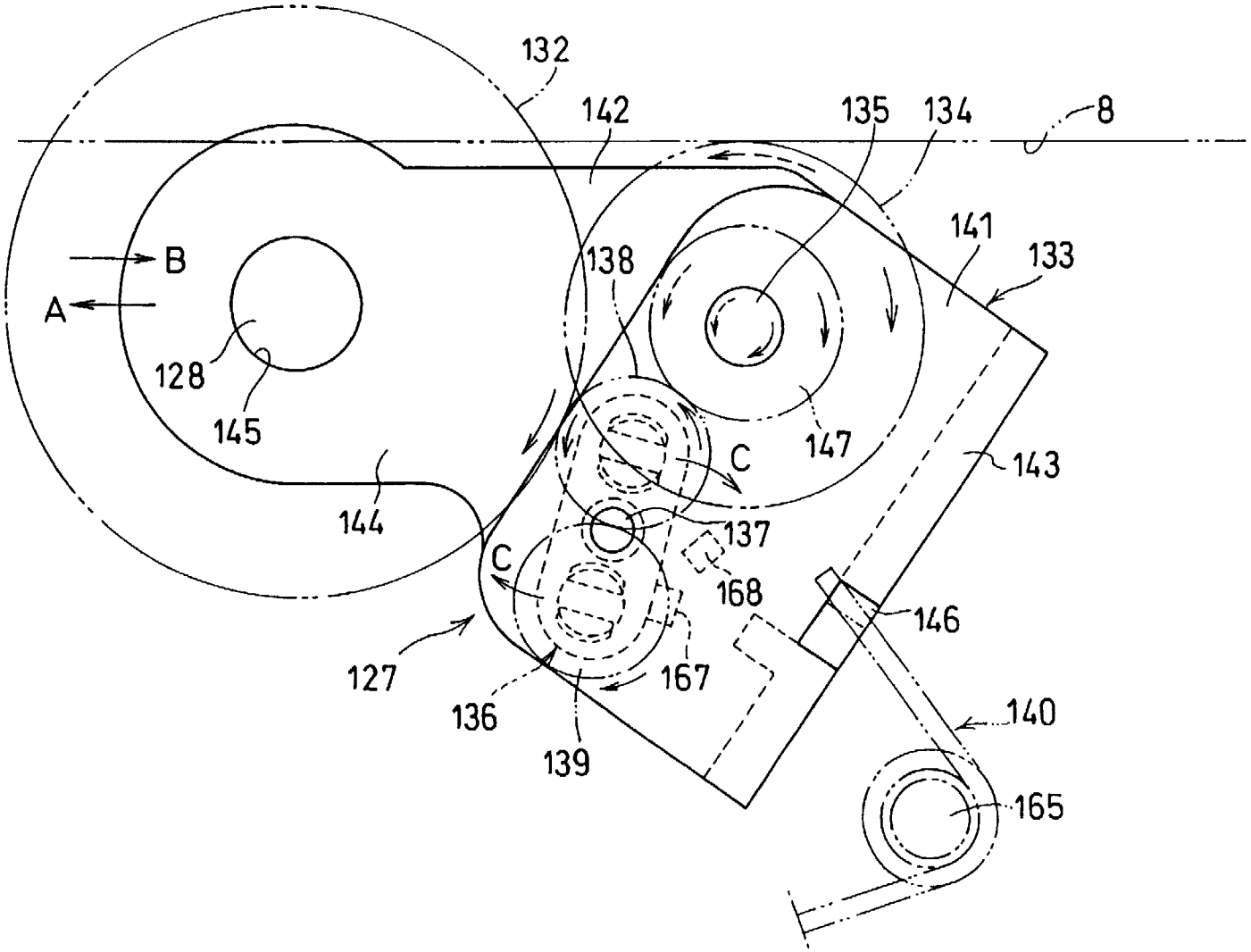
FIG. 10 is a detail view of the ribbon feeding device of FIG. 9, in a state where a first transmission gear is engaged with a ribbon feed gear.

As shown in FIG. 10, the pivot shaft 137 projects from a central portion of the second holder 136 and is rotatably supported on the second holder 133. A first transmission gear 138 is rotatably mounted on one end of the second holder 136. The first transmission gear 138 comes into and out of engagement with the ribbon feed gear 132 in accordance with the forward and reverse turning of the second holder 136 in response to the rotation of the pinion 134. A second transmission gear 139 is rotatably mounted on the other end of the second holder 136. The second transmission gear 139 is always engaged with the first transmission gear 138 and brought into engagement with the ribbon feed gear 132 when the ribbon feed gear 132 and the first transmission gear 138 are out of engagement and is brought out of engagement with the ribbon feed gear 132 when the ribbon feed gear 132 and the first transmission gear 138 are in engagement.

As shown in FIG. 9, on the back side of the carriage 105, a torsion coil spring 140 is supported which urges the pinion 134, which is rotatably supported on the first holder 133, towards the rack 8 via the first holder 133.

As shown in FIG. 10, the ribbon feed mechanism 127 for rotating the ribbon feed shaft 110 in the ribbon feeding direction upon receipt of the driving force from the rack 8 when the carriage 105 is moved along the rack 8, comprises the first holder 133 swingably supported on the pivot shaft 128, the pinion 134 rotatably supported on the first holder 133 via the shaft 135 and meshing with the rack 8, the second holder 136 pivotally supported on the first holder 133 via the pivot shaft 137, the first transmission gear 138 rotatably supported on one end of the second holder 136, and the second transmission gear 139 rotatably supported on the other end of the second holder 136.

Figure 13:
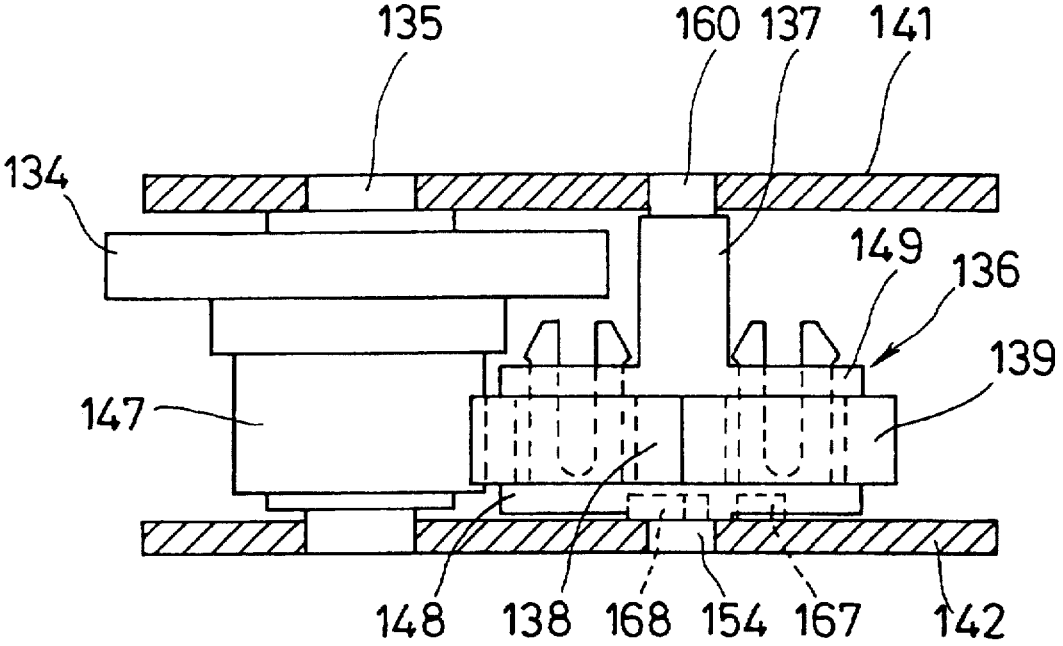
FIG. 13 is a cross-sectional view of a principal part of the ribbon feeding device shown in FIG. 10.

As shown in FIGS. 10 and 13, the first holder 133 has a front plate 141, a back plate 142 parallel to the front plate 141, and a side plate extending between one side edge of the front plate 141 and one side edge of the back plate 141. The back plate 142 has an arm 144 projecting from the other edge obliquely downwardly. The arm 144 has a pivot hole 145 through which the pivot shaft 128 of the support member 126 is inserted. The side plate 143 of the first holder 133 has a through hole 146 through which one end of the torsion coil spring 140 is inserted.

Between the front plate 141 and the back plate 142 of the first holder 133, the shaft 135 of the pinion 134 and the pivot shaft 137 of the second holder 136 parallel to the shaft 135 are rotatably supported. On the inner surface of the back plate 142, first and second stoppers 167 and 168 are provided to face the second holder 136 for restricting the forward and reverse pivotal movement of the second holder 136 about the pivotal shaft 137.

As shown in FIG. 13, the pinion 134 is supported on the first holder 133 near the front plate 141, and a transmission gear 147 formed on the shaft 135 of the pinion 134 coaxially and integrally with the pinion 134 and smaller in diameter than the pinion 134 is disposed near the back plate 142 of the first holder 133. On the first holder 133, the pinion 134 and the transmission gear 147 are rotatably supported by the shaft 135.

Figure 14:
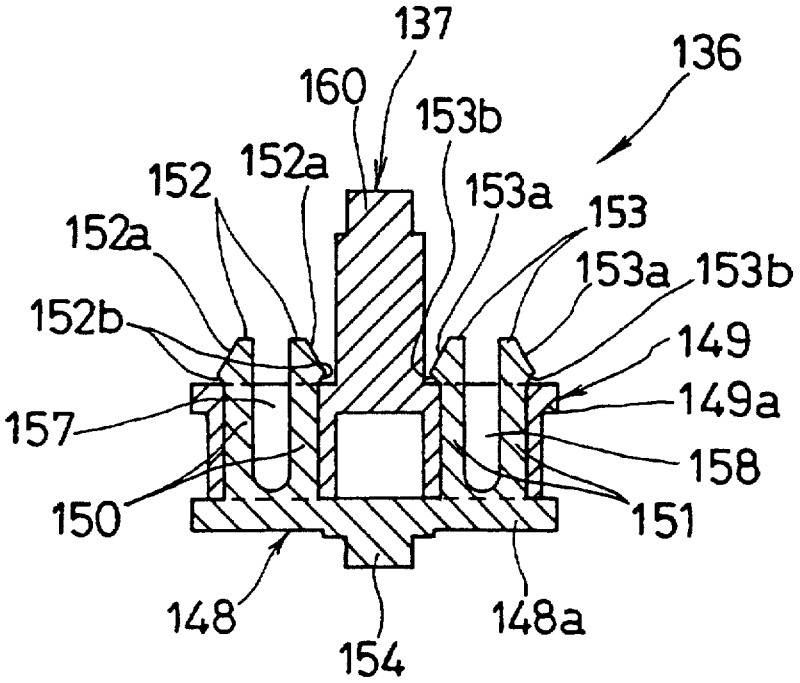
FIG. 14 is a longitudinal cross-sectional view of a second holder in FIG. 13.
Figure 15:
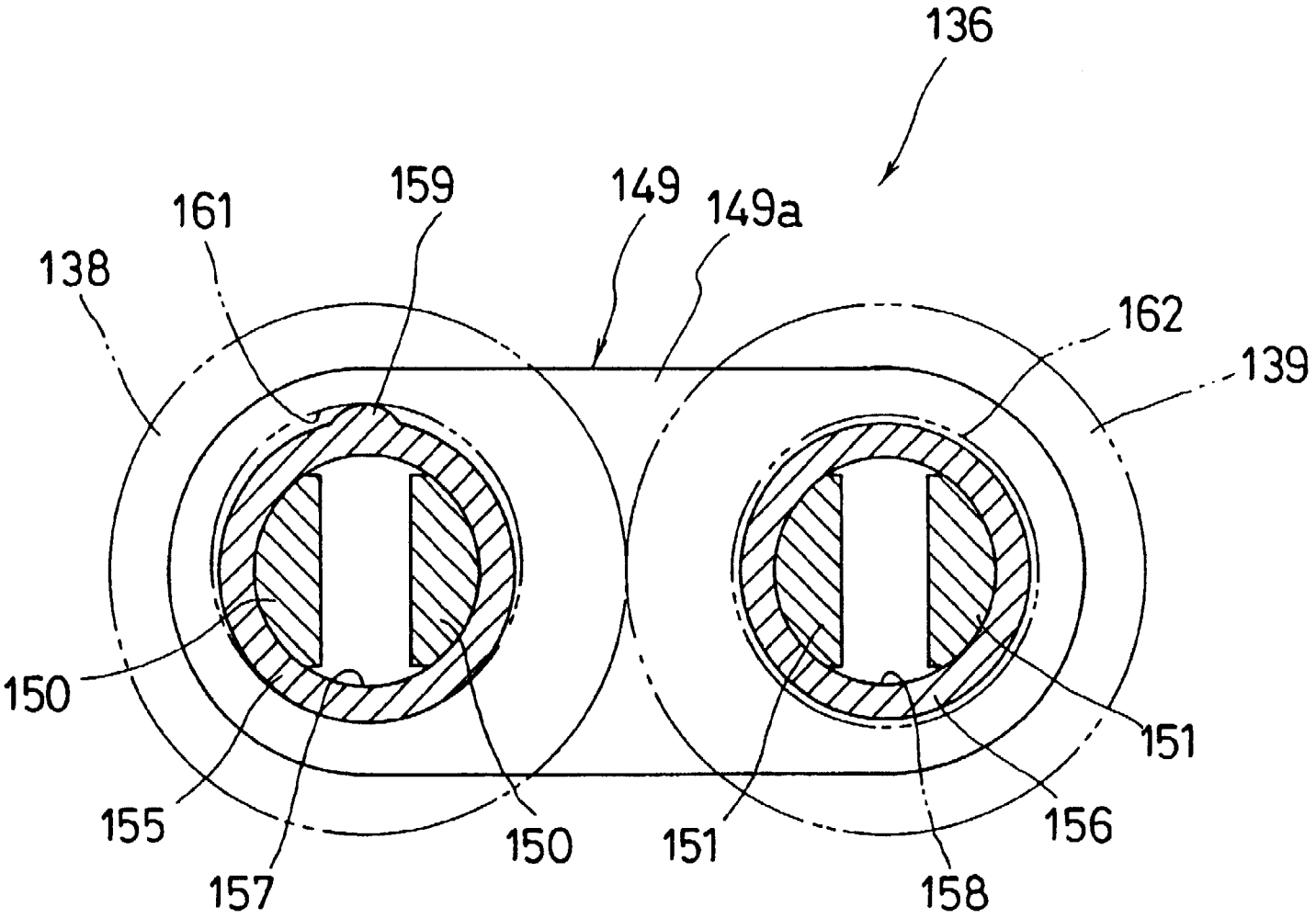
FIG. 15 is a transverse cross-sectional view of the second holder.

As shown in FIGS. 14 and 15, the second holder 136 is composed of upper and lower holder members 149, 148. As shown in FIG. 14, on a holder base 148*a* of the lower holder member 148 at opposite sides thereof, two pairs of parallel locking strips 150 and 151 stand inwardly of the second holder 136. As shown in FIG. 15, each pair of locking strips 150 and 151 has a pair of respective outer arcuate surfaces. As shown in FIG. 14, each locking strip 150, 151 has at its distal end an outwardly directed locking hook 152, 153 having a tapered head 152*a*, 153*a* sloping outwardly from the distal end and a jaw 152*b*, 153*b* at the base of the tapered head 152*a*, 153*a*.

Each pair of locking strips 150 and 151 is resilient in such a manner that the locking head 152, 153 can be restorably bent toward each other. Centrally on the outer surface of the holder base 48*a* of the lower holder member 148, a pivotal protuberance 154 is formed.

As shown in FIG. 15, on a holder base 149*a* of the upper holder member 149 on one side, a tubular first-transmission-gear shaft 155 is formed. On the holder base 149*a* of the upper holder member 149 on the other side, a tubular second-transmission-gear shaft 156 is formed. Each of the first-transmission-gear and second-transmission-gear shafts 155, 156 has a through-hole 157, 158 through which each pair of locking strips 150 and 151 of the lower holder member 148 is inserted.

Also as shown in FIG. 15, the first-transmission-gear shaft 155 has a protrusion 159 bulging from its outer circumferential surface and having a substantially arcuate circumferential surface. As shown in FIG. 14, the pivot shaft 137 of the second holder 136 projects centrally from the holder base 149*a* and a pivotal support portion 160 is formed on a distal end of the pivot shaft 137.

The first transmission gear 138 has a gear hole 161 through which the first-transmission-gear shaft 155 of the upper holder member 149 is inserted, while the second transmission gear 139 has a gear hole 162 through which the second-transmission-gear shaft 156 of the upper holder member 149 is inserted. The first and second transmission gears 138, 139 mesh with each other. As shown in FIG. 14, one pair of locking strips 150 of the lower holder member 148 is inserted through the through-hole 157 of the first-transmission-gear shaft 155 of the upper holder member 149 with their locking hooks 152 projecting from the trough-hole 157 and caught at the respective jaws 152*b* on the peripheral edge of the through-hole 157. Likewise, the other pair of locking strips 151 of the lower holder member 148 is inserted through the through-hole 158 of the second-transmission-gear shaft 156 of the upper holder member 149 with their locking hooks 153 projecting from the through-hole 158 and caught at the respective jaws 153*b* on the peripheral edge of the through-hole 158. Thus the lower and upper holder members 148, 149 are joined together.

Turning back to FIG. 15, the first transmission gear 138 is rotatably supported on the first-transmission-gear shaft 155 of one end of the second holder 136, and the second transmission gear 139 is rotatably supported on the second-transmission-gear shaft 156 of the other end of the second holder 136, so that the first and second transmission gears 138 and 139 are always meshing with each other. The protrusion 159 on the outer circumferential surface of the first-transmission-gear shaft 155 is pressed against the inner circumferential surface of the gear hole 161 of the first transmission gear 138 and at the same time the inner circumferential surface of the gear hole 161 of the first transmission gear 138 is pressed against part of the outer circumferential surface of the first-transmission-gear shaft 155 at the diagonally opposite side remote from the protrusion 159, thus generating a braking force against the rotation of the first transmission gear 138 and hence the rotation of the second transmission gear 139 meshing with the first transmission gear 138.

As shown in FIG. 13, the pivotal support portion 154 projecting centrally from the lower member 148 is rotatably supported on the back plate 142 of the first holder 133, while the pivotal support portion 160 formed on the distal end of the pivot shaft 137 is rotatably supported on the front plate 141 of the first holder 133. Thus the second holder 136 is pivotally supported on the first holder 133 and is pivotally movable about the pivot shaft 137, and the first transmission gear 138 rotatably mounted on one end of the second holder 136 always meshes with the transmission gear 147, which is coaxial with the pinion 134, and comes selectively into and out of engagement with the ribbon feed gear 132 in accordance with the forward and reverse angular movement of the second holder 136 due to the direction of rotation of the pinion 134. The second transmission gear 139 rotatably supported on the other end of the second holder 136 always meshes with the first transmission gear 138 and brought into engagement with the ribbon feed gear 132 when the first transmission gear 138 is out of engagement with the ribbon feed gear 132, and is brought out of engagement with the ribbon feed gear 132 when the first transmission gear 138 is in engagement with the ribbon feed gear 132.

The first and second stoppers 167,168 (FIGS. 10 and 13) mounted on the back plate 142 of the first holder 133 selectively one at a time come into contact with the side edge of the lower member 148 of the second holder 136 in accordance with the forward and reverse angular movement of the second holder 136 due to the direction of rotation of the pinion 134, thus restricting the forward and reverse angular movement of the second holder 136 in order to make a depth of meshing between the first transmission gear 138 and the ribbon feed gear 132 and a depth of meshing between the second transmission gear 139 and the ribbon feed gear 132 to an appropriate degree.

Turning back to FIG. 9, the carriage 105 has a through-hole, through which the ribbon feed shaft 110 is inserted, and four locking holes 163 at positions corresponding to the four supporting legs 129 of the support member 126. In each locking hole 163, a locking stepped portion 164 is formed for catching the jaw 130*b* of the respective supporting leg 129. The four supporting legs 129 of the support member 126 are inserted into the four locking holes 163, respectively, of the carriage 105 with their jaws 130*b* caught by the respective stopped portions 164 in the corresponding locking holes 163 of the carriage 105, thus attaching the support member 126 to the carriage 105 on the back side with the ribbon feed gear 132 and the first holder 133 being rotatably supported on the pivot shaft 128 of the support member 126.

As shown in FIG. 10, the torsion coil spring 140 is wound around a boss 165 projecting toward the back side of the carriage 105, and one end of the torsion coil spring 140 is inserted into the through-hole 146, which is formed on the side plate 143 of the first holder 133, and is held on an edge of the through-hole 146. As shown in FIG. 9, the other end of the torsion coil spring 140 is held on the upper surface of a wall 166 projecting toward the back side of the carriage 105. The torsion coil spring 140 urges the first holder 133 to angularly move counterclockwise about the pivot shaft 128 in FIGS. 9 and 10 to thereby urge the pinion 134, which rotatably supported on the first holder 133, towards the rack 8, so that the engagement between the rack 8 and the pinion 134 is always maintained.

Figure 16:
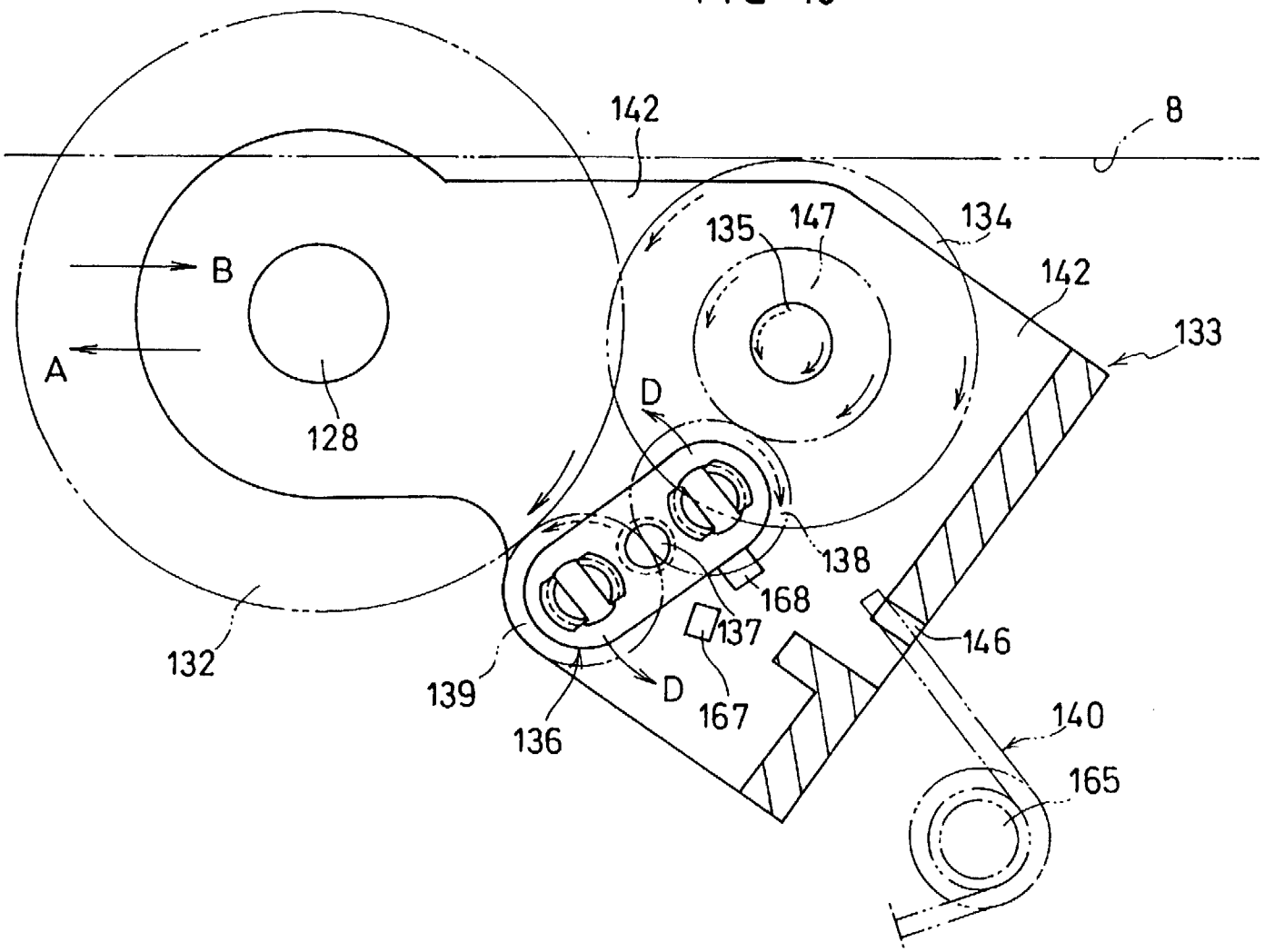
FIG. 16 is a detail view, with parts broken away, of the ribbon feed apparatus, in a state where the first transmitting gear is out of engagement with the ribbon feed gear and a second transmission gear is in engagement with the ribbon feeding gear.

The operation of the ribbon feeding device 127 of this embodiment will be described. FIG. 10 shows the ribbon feed mechanism 127 in a state where the first transmission gear 138 of the second holder 136 is in engagement with the ribbon feed gear 132, and FIG. 16 shows the ribbon feed mechanism 127 in a state where the first transmission gear 138 is out of engagement with the ribbon feed gear 132 and the second transmission gear 139 is in engagement with the ribbon feed gear 132.

First, the ribbon feeding operation of the device 127 in response to the horizontal movement of the carriage 105 will be described. It is assumed that the first transmission gear 138 of the second holder 136 is in engagement with both the coaxial transmission gear 147 and the ribbon feed gear 132, as shown in FIG. 10. The first stopper 167 on the first holder 133 is in contact with the side edge of the second holder 136 to restrict the angular position of the second holder 136, to maintain the depth of engagement between the first transmission gear 138 and the ribbon feed gear 132 to an appropriate degree.

Figure 2:
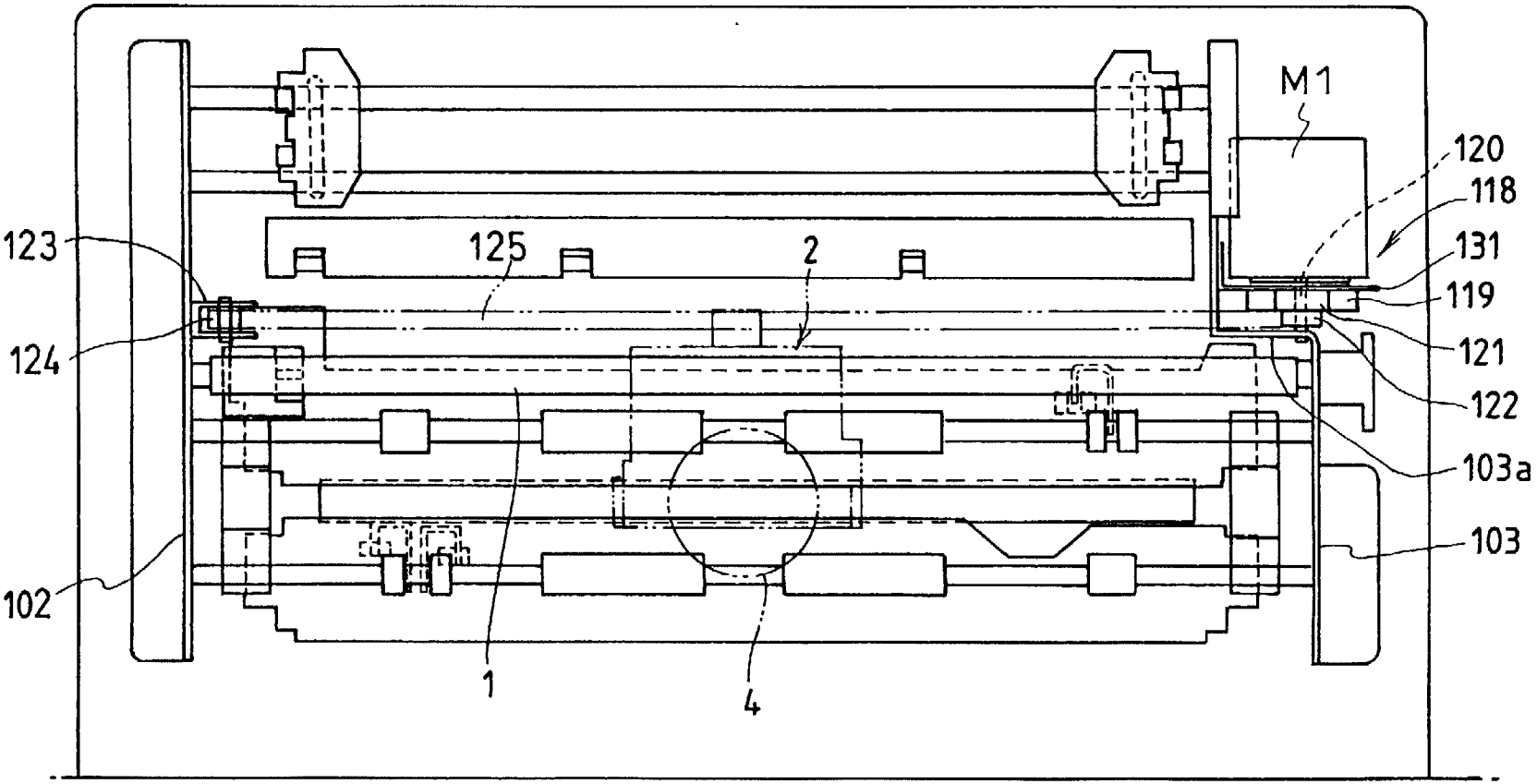
FIG. 2 is a plan view of the printer of FIG. 1.

It is also assumed that, when the carriage moving motor M1 of FIG. 2 rotates forward, the carriage 105 is moved to the left side along the carriage shaft 1 in the direction of the solid-line arrow A in FIG. 8, and when the carriage moving motor M1 rotates reversely, the carriage 105 is moved to the right side along the carriage shaft I in the direction of the dotted-line arrow B in FIG. 8.

In FIG. 8, when the carriage 105 is moved to the left side along the carriage shaft 1 in response to the forward rotation of the carriage moving motor M1, the first holder 133 pivotally supported on the pivot shaft 128 of the carriage 105 is moved to the left side along the rack 8 in the direction of the arrow A together with the carriage 105, as shown in FIG. 10, so that the pinion 134 rotatably supported on the first holder 133 is moved to the left side on the rack 8 in the direction of the arrow A, in mesh with the rack 8. In response to this movement of the first holder 133 in the direction of the arrow A, the pinion 134 and the coaxial transmission gear 147 are rotated clockwise in the direction of the solid-line arrows together with the shaft 135.

Simultaneously, the clockwise rotation of the pinion 134, i.e., the clockwise rotation of the coaxial transmission gear 147, is transmitted to the first transmission gear 138, so that the first transmission gear 138 is rotated counterclockwise in the direction of the solid-line arrow.

This counterclockwise rotation of the first transmission gear 138 is transmitted to the ribbon feed gear 132 and the second transmission gear 139 so that the ribbon feed gear 132 and hence the ribbon feed shaft 110 are rotated clockwise about the pivot shaft 128, thus feeding the ink ribbon 111 of the ink ribbon cassette 112 of FIG. 8 in the winding direction, while the second transmission gear 139 is rotated idle clockwise.

In FIG. 8, when the carriage 105 is moved to the right side along the carriage shaft 1 in the direction of the dotted-line arrow B in response to the reverse rotation of the carriage moving motor M1, the first holder 133 pivotally supported on the pivot shaft 128 of the carriage 105 is moved to the right side along the rack 8 in the direction of the arrow B in FIG. 10 so that the pinion 134 rotatably supported on the first holder 133 is moved to the right side in the direction of the arrow B, in mesh with the rack 8. This rightward movement of the first holder 133 causes the pinion 134 and the coaxial transmission gear 147 to rotate counterclockwise in the direction of the dotted-line arrow together with the shaft 135.

At the same time, the counterclockwise rotation of the pinion 134 is transmitted through the coaxial transmission gear 147 in such a direction that the first transmission gear 138 in mesh with the coaxial transmission gear 147 is rotated clockwise. However, due to the braking force by the protrusion 159 (FIG. 15) on the circumferential surface of the first-transmission-gear shaft 155, the first transmission gear 138 is not rotated clockwise so that the second transmission gear 139 also is not rotated. Therefore, the counterclockwise rotation of the coaxial transmission gear 147 is transmitted to the upper end of the second holder 136 via the first transmission gear 138 so that the second holder 136 is angularly moved clockwise about the pivot shaft 137 in the direction of the solid-line arrow C in FIG. 10.

As a result, the upper end of the second holder 136 is moved away from the ribbon feed gear 132 and, at the same time, the lower end of the second holder 136 is moved toward the ribbon feed gear 132. In response to the clockwise angular movement of the second holder 136 about the pivot shaft 137, the first transmission gear 138 rotatably mounted on the upper end of the second holder 136 is released from meshing with the ribbon feed gear 132 and at the same time the second transmission gear 139 rotatably mounted on the lower end of the second holder 136 comes into meshing with the ribbon feed gear 132 (FIG. 16).

As shown in FIG. 16, the clockwise angular movement of the second holder 136 about the pivot shaft 137 is stopped when the side edge of the second holder 136 near the upper end comes into contact with the second stopper 168 on the first holder 133. At that time, the second transmission gear 139 comes into meshing with the ribbon feed gear 132, and the engagement between the second transmission gear 139 and the ribbon feed gear 132 is adjusted in an appropriate state.

Also as shown in FIG. 16, upon termination of clockwise angular movement of the second holder 136 about the pivot shaft 137, the counterclockwise rotating force of the coaxial transmission gear 147 becomes greater than the braking force by the protrusion 159, so that the first transmission gear 138 is rotated clockwise in the direction of the dotted-line arrow about the first-transmission-gear shaft 155.

This clockwise rotation of the first transmission gear 138 is transmitted to the ribbon feed gear 132 through the second transmission gear 139, so that the ribbon feed gear 132 and the ribbon feed shaft 110 are rotated clockwise about the pivot shaft 128 of the first holder 133 in FIG. 11 to feed the ink ribbon 111 of the ink ribbon cassette 112 of FIG. 8.

In a state where the first transmission gear 138 is out of engagement with the ribbon feed gear 132, and the second transmission gear 139 is in engagement with the ribbon feed gear 132, as shown in FIG. 16, when the carriage 105 is moved toward the left side along the carriage shaft 1 in the direction of the solid-line arrow A as the direction of rotation of the carriage moving motor M1 is changed from reverse to forward, the first holder 133 is moved to the left side in the direction of the arrow A in FIG. 16 together with the carriage 105 so that the pinion 111 is moved to the left side in the direction of the arrow A in meshing with the rack 8. As a result, the pinion 134 and the coaxial transmission gear 147 are rotated clockwise in the direction of the solid-line arrow together with the shaft 135.

Simultaneously, the clockwise rotation of the pinion 134 is transmitted to the first transmission gear 138 through the coaxial transmission gear 147 so that the first transmission gear 138 is rotated counterclockwise. However, due to the braking force by the protrusion 159, the second transmission gear 139 is not rotated counterclockwise about the first-transmission-gear shaft 155. Therefore, the clockwise rotation of the coaxial transmission gear 147 is transmitted to the upper end of the second holder 136 via the first transmission gear 138 so that the second holder 136 is angularly moved counterclockwise about the pivot shaft 137 in the direction of the solid-line arrow in FIG. 11. As a result, the upper end of the second holder 136 is moved toward the ribbon feed gear 132 and at the same time the lower end of the second holder 136 is moved away from the ribbon feed gear 132. In response to this counterclockwise angular movement of the second holder 136 about the pivot shaft 137, the first transmission gear 138 comes into meshing with the ribbon feed gear 132 and at the same time the second transmission gear 139 is released from meshing with the ribbon feed gear 132 (FIG. 10).

The counterclockwise angular movement of the second holder 136 about the pivot shaft 137 is stopped when the side edge of the second holder 136 near the lower end comes into contact with the first stopper 167 on the first holder 133. At that time, the second transmission gear 139 comes into engagement with the ribbon feed gear 132, and the engagement between the first transmission gear 138 and the ribbon feed gear 132 is maintained in an appropriate state.

As shown in FIG. 10, upon termination of clockwise angular movement of the second holder 136 about the pivot shaft 137, the counterclockwise rotating force of the coaxial transmission gear 147 becomes greater than the braking force by the protrusion 159, which is formed on the outer circumferential surface of the first transmission gear 155, so that the first transmission gear 138 is rotated counterclockwise in the direction of the solid-line arrow about the first-transmission-gear shaft 155.

This counterclockwise rotation of the first transmission gear 138 is directly transmitted to the ribbon feed gear 132 so that the ribbon feed gear 132 and the ribbon feed shaft 110 are rotated clockwise about the pivot shaft 128 in FIG. 10 to feed the ink ribbon 111 of the ink ribbon cassette 112 of FIG. 8 and at the same time the second transmission gear 139 is rotated idle clockwise.

The following is a description of the manner in which the carriage 105 is moved vertically toward and away from the platen 3 in order to adjust the distance between the platen 3 and the printing head 4 in accordance with the thickness of a paper sheet to be supplied to the space between the platen 3 and the ink ribbon 11. The range of movement of the carriage 105 is *0.3–2.0* mm.

Figure 17:
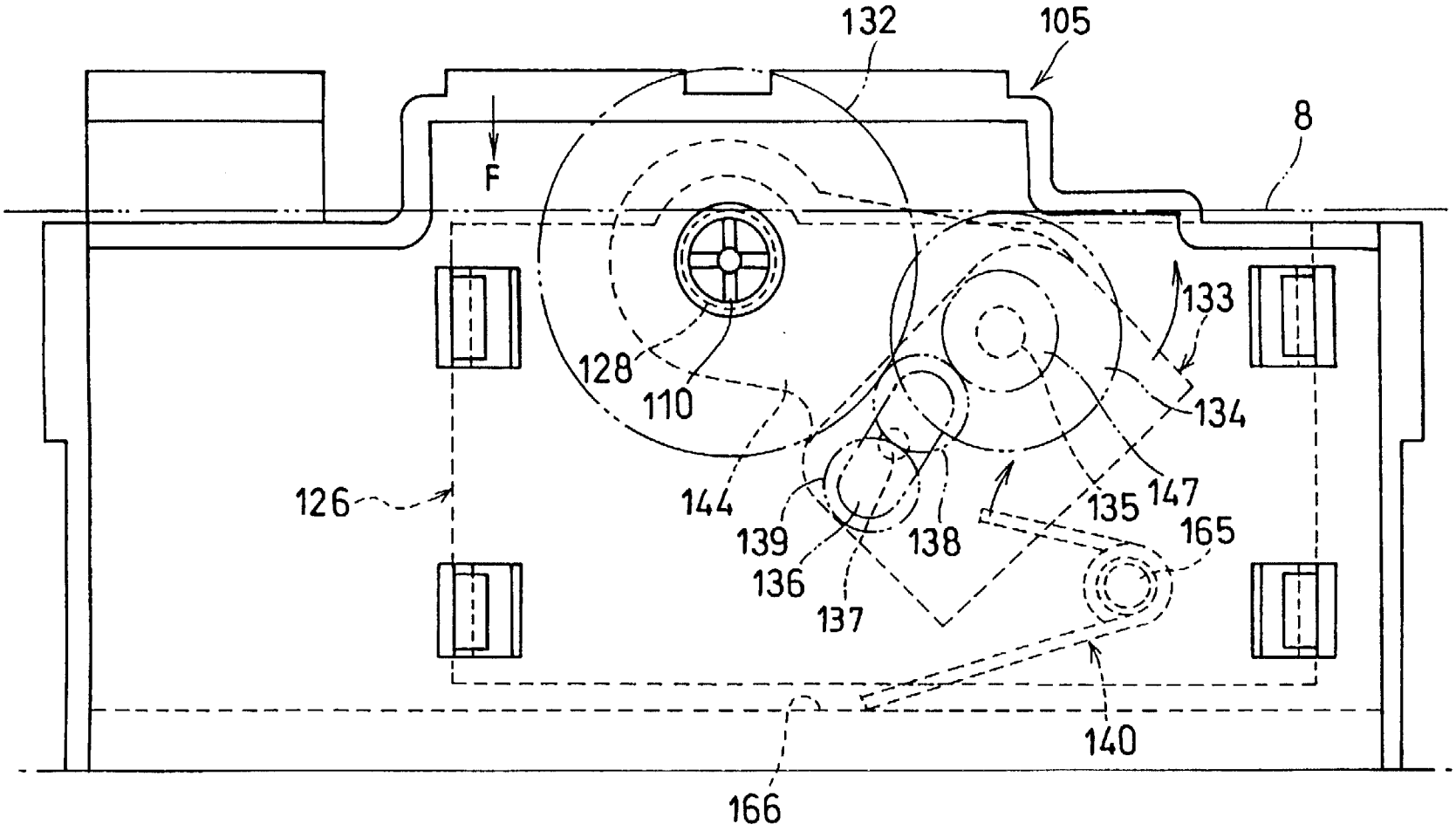
FIG. 17 is an enlarged front view of the ribbon feeding device of FIG. 8, in a state where the carriage is placed farthest from the platen.

FIG. 9 shows a state in which the carriage 105 carrying the printing head 4 of FIG. 8 is moved closest to the platen 3. FIG. 17 shows a state in which the carriage 105 is moved farthest away from the platen 3.

When the carriage 105 is moved away from the platen 3 from the position of FIG. 9, the carriage 105 is moved upwardly toward the rack 8 in the direction of the solid-line arrow E in FIG. 9. In response to this upward movement of the carriage 105, the pivot shaft 128 of the carriage 105 is moved upwardly with the carriage 105 to move the distal end of the arm 144 of the first holder 133 upwardly in FIG. 9. At the same time, however, the rack 8 presses the pinion 134 engaged with the rack 8 downwardly. As a result, according to the upward movement of the carriage 105, the first holder 133 swings clockwise about the pivot shaft 128, compressing the torsion coil spring 140, so that the engagement between the pinion 134 and the rack 8 is maintained.

Upon termination of the upward movement of the carriage 105 in the direction of the arrow E, the swinging movement of the first holder 133 and the rotation of the pinion 134 are stopped simultaneously. When the carriage 105 is moved to the upward position, the first holder 133 assumes the posture of FIG. 17 as the pinion 134 and the rack 8 are kept in mesh with each other under the urging force of the torsion coil spring 140.

When the carriage 105 is moved toward the platen 3 from the position of FIG. 17, the carriage is moved downwardly away from the rack 8 in the direction of the solid-line arrow F in FIG. 17. In response to this downward movement of the carriage 105, the pivot shaft 128 of the carriage 105 is moved downwardly with the carriage 105 so that the distal end of the arm 144 of the first holder 133 downwardly. At the same time, however, the first holder 133 is pushed upwardly toward the rack 8 by the elastic force of the torsion coil spring 140. As a result, according to the downward movement of the carriage 105, the first holder 133 swings counterclockwise about the pivot shaft 128 toward the rack 8 in FIG. 17, while maintaining the engagement between the pinion 134 and the rack 8.

Upon termination of the downward movement of the carriage 105 in the direction of the arrow F, the swinging movement of the first holder 133 and the rotation of the pinion 134 are stopped simultaneously. When the carriage 105 is moved to the downward position, the first holder 133 assumes the posture of FIG. 9 as the pinion 134 and the rack 8 are kept in mesh with each other under the urging force of the torsion coil spring 140.

According to the ribbon feeding device of the second embodiment, the first holder 133 swings when the carriage 105 is moved vertically, i.e. either upwardly or downwardly, so that the pinion 134 and the rack 8 is kept in mesh with each other under the urging force of the torsion coil spring 140. Therefore, it is unnecessary to provide the rack 8 with a portion for directly engaging the carriage 105, thus making the apparatus simple in structure and hence easy to assemble.

Further, either when the carriage 105 is move to assume the posture of FIG. 9 closest to the platen 3 or when the carriage 10 is moved to assume the posture of FIG. 17 farthest away from the platen 3, it is possible to arrange the moving direction of the pinion 134 toward and away form the rack 8 to a substantially right angle, since the first holder 133 rotatably supporting the pinion 134 is swingably supported on the pivot shaft 128 mounted on the carriage 105 near the distal end thereof. It is therefore possible to realize well-balanced loading between the meshed rack 8 and the pinion 134 either when the carriage 105 is moved to the left side or the right side.

According to the present invention, it is possible to maintain the pinion and the rack in sure meshing with each other when the carriage is moved toward and away from the rack and it is unnecessary to provide the rack with any member for direct engagement with the carriage, thus making the apparatus simple in structure and hence easy to assemble.

In the first embodiment, using the restricting means for restricting the depth of meshing between the rack and the pinion to an appropriate degree, it is possible to adjust the mesh between the rack and pinion to an appropriate degree of friction so that the pinion is prevented from overmeshing with the pinion, thus realizing smooth movement and rotation of the pinion along the rack. In the second embodiment, using the stoppers for restricting the range of angular movement of the second holder, it is possible to maintain the mesh between the first transmission gear and ribbon feed gear and also the mesh between the second transmission gear and the ribbon feed gear in appropriate state without increasing the rotational load.

What is claimed is:

1. A ribbon feeding device for feeding a ribbon on an ink ribbon cassette in one direction for a printer, comprising:

a carriage, on which said ink ribbon cassette is detachably mounted, for moving said ink ribbon cassette together with a printing head in a direction traversing a paper feeding direction;

a stationary rack extending in the moving direction of said carriage;

an arm swingably supported on a pivot shaft provided on said carriage;

a pinion rotatably supported on said arm and engaged with said rack to be rotated by said rack when said carriage moves in the direction traversing the paper feeding direction;

urging means for urging said arm to swing about said pivot shaft to thereby urge said pinion towards said rack; and a transmission mechanism for transmitting the rotation of said pinion to a rotation input member of said ink ribbon cassette.

2. A ribbon feeding device according to claim 1, wherein said urging means comprises a spring having one end engaged with said arm and the other end engaged with said carriage.

3. A ribbon feeding device according to claim 1, further comprising restricting means for restricting a depth of engagement between said rack and said pinion urged by said urging means within a predetermined degree.

4. A ribbon feeding device according to claim 3, wherein said restricting means comprises a follower roller rotatably supported on said arm to be rotated with the movement of said carriage, and a guide member extending parallel to said rack.

5. An ribbon feeding device for feeding a ribbon of an ink ribbon cassette in one way in a printer, comprising:

a carriage, on which said ink ribbon cassette is detachably mounted, for moving said ink ribbon cassette with a printing head in a direction traversing a paper feeding direction;

a rack extending in the moving direction of said carriage;

a ribbon feed gear having a coaxially and integrally formed ribbon feed shaft, and rotatably supported on a first pivot shaft provided on said carriage;

a first holder provided swingable about said first pivot shaft;

a pinion rotatably supported on said first holder and engaged with said rack;

a second holder rotatably supported on a second pivot provided on said first holder;

a first transmission gear rotatably mounted on one end of said second holder, for receiving the rotation of said pinion to rotate said second holder to come into and out of engagement with said ribbon feed gear;

a second transmission gear rotatably supported on the other end of said second holder and always engaged with said first transmission gear, said second transmission gear being brought into engagement with said ribbon feed gear when said first transmission gear is out of engagement with said ribbon feed gear and brought out of engagement with said ribbon feed gear when said first transmission gear is in engagement with said ribbon feed gear; and urging means for urging said first holder to swing about said first pivot shaft to thereby urge said pinion towards said rack.

6. A ribbon feeding device according to claim 5, further comprising braking force generating means provided on at least one of a gear shaft of said first transmission gear and a gear shaft of said second transmission gear, for generating a braking force against the rotation of said first transmission gear and said second transmission gear.

7. A ribbon feeding device according to claim 5, wherein said urging means comprises a spring having one end engaged with said first holder and the other end engaged with said carriage.

8. A ribbon feeding device according to claim 5, further comprising a restricting member provided on said first holder for restricting a range of rotation of said second holder to optimize a depth of engagement between said first transmission gear and said ribbon feed gear and a depth of engagement between said second transmission gear and said ribbon feed gear.

9. A ribbon feeding device according to claim 5, wherein said rack is stationary.

* * * * *